US010360827B2

(12) United States Patent
Bi et al.

(10) Patent No.: US 10,360,827 B2
(45) Date of Patent: Jul. 23, 2019

(54) SYSTEMS AND METHODS FOR INDIRECT THRESHOLD VOLTAGE SENSING IN AN ELECTRONIC DISPLAY

(71) Applicant: Apple Inc., Cupertino, CA (US)

(72) Inventors: Yafei Bi, Palo Alto, CA (US); Xiaofeng Wang, San Jose, CA (US); Haifeng Li, Campbell, CA (US); Mohammad B. Vahid Far, San Jose, CA (US); Hopil Bae, Sunnyvale, CA (US); Hung Shen Lin, San Jose, CA (US); Hyunwoo Nho, Stanford, CA (US); Wei H. Yao, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 150 days.

(21) Appl. No.: 15/273,470

(22) Filed: Sep. 22, 2016

(65) Prior Publication Data

US 2017/0103703 A1 Apr. 13, 2017

Related U.S. Application Data

(60) Provisional application No. 62/239,694, filed on Oct. 9, 2015, provisional application No. 62/305,941, filed on Mar. 9, 2016.

(51) Int. Cl.

| | |
|---|---|
| ***G09G 3/3233*** | (2016.01) |
| ***G09G 3/3266*** | (2016.01) |
| ***G09G 3/3291*** | (2016.01) |
| ***G09G 3/00*** | (2006.01) |

(52) U.S. Cl.

CPC ..... *G09G 3/006* (2013.01); *G09G 3/3233* (2013.01); *G09G 3/3266* (2013.01); *G09G 3/3291* (2013.01); *G09G 2300/0809* (2013.01); *G09G 2310/0202* (2013.01); *G09G 2310/0291* (2013.01); *G09G 2310/061* (2013.01); *G09G 2320/0233* (2013.01); *G09G 2320/045* (2013.01); *G09G 2330/12* (2013.01)

(58) Field of Classification Search

CPC ..... G09G 2330/12; G09G 2320/045; G09G 2320/0233; G09G 2300/0809; G09G 2310/061; G09G 2310/0291; G09G 2310/0202; G09G 3/3233; G09G 3/3291; G09G 3/3266; G09G 3/006

See application file for complete search history.

(56) References Cited

U.S. PATENT DOCUMENTS

| | | | | |
|---|---|---|---|---|
| 9,824,618 | B2 * | 11/2017 | Ohara | G09G 3/2018 |
| 9,852,690 | B2 * | 12/2017 | Tsuge | G09G 3/325 |
| 9,881,552 | B2 * | 1/2018 | Kishi | G09G 3/3233 |
| 2008/0297055 | A1 * | 12/2008 | Miyake | G09G 3/3233 315/169.2 |
| 2012/0293478 | A1 * | 11/2012 | Chaji | G09G 3/3258 345/212 |

(Continued)

*Primary Examiner* — Priyank J Shah
(74) *Attorney, Agent, or Firm* — Fletcher Yoder, P.C.

(57) ABSTRACT

An electronic device includes one or more unit pixels and threshold voltage (Vth) sensing circuitry. The threshold voltage sensing circuitry senses Vth of the one or more unit pixels, by: sampling a charge of a capacitor of the one or more unit pixels, transitioning from the sampling, and reading out the threshold voltage based upon a change in the charge of the capacitor, such that an operation of the one or more unit pixels may be modified based upon the threshold voltage.

18 Claims, 32 Drawing Sheets

(56) References Cited

U.S. PATENT DOCUMENTS

2013/0201173 A1* 8/2013 Chaji ..... G09G 3/3233 345/212
2014/0152642 A1* 6/2014 Kim ..... G09G 3/3233 345/212
2015/0243217 A1* 8/2015 Park ..... G09G 3/3258 345/76
2015/0294626 A1* 10/2015 Bi ..... G09G 3/3233 345/211
2015/0379909 A1* 12/2015 Yu ..... G09G 3/006 345/690
2015/0379937 A1* 12/2015 Kim ..... G09G 3/006 345/691
2016/0012798 A1* 1/2016 Oh ..... G09G 3/325 345/205
2016/0071463 A1* 3/2016 Takahashi ..... G09G 3/3225 345/76
2016/0078805 A1* 3/2016 Woo ..... G09G 3/3225 345/78
2016/0078806 A1* 3/2016 Lim ..... G09G 3/3275 345/690
2016/0104422 A1* 4/2016 Kishi ..... G09G 3/3233 345/205
2016/0111044 A1* 4/2016 Kishi ..... G09G 3/3233 345/690
2016/0155377 A1* 6/2016 Kishi ..... G09G 3/3233 345/214
2016/0155380 A1* 6/2016 Kwon ..... G09G 3/3233 345/78
2016/0163255 A1* 6/2016 Kim ..... G09G 3/2003 345/212
2016/0163265 A1* 6/2016 Yang ..... G09G 3/3233 345/690
2017/0025061 A1* 1/2017 Takizawa ..... G09G 3/3233
2017/0061878 A1* 3/2017 Park ..... G09G 3/3233
2017/0103688 A1* 4/2017 Bi ..... G09G 3/006
2017/0103702 A1* 4/2017 Bi ..... G09G 3/006
2017/0186373 A1* 6/2017 Nishikawa ..... G09G 3/3258
2017/0270855 A1* 9/2017 Maeda ..... G09G 3/3233
2017/0372656 A1* 12/2017 Furukawa ..... G09G 3/3233
2018/0005579 A1* 1/2018 Brahma ..... G09G 3/3258
2018/0033372 A1* 2/2018 Kishi ..... G09G 3/3258
2018/0082642 A1* 3/2018 Yamanaka ..... G09G 3/3291

* cited by examiner

SYSTEMS AND METHODS FOR INDIRECT THRESHOLD VOLTAGE SENSING IN AN ELECTRONIC DISPLAY

CROSS REFERENCE TO RELATED APPLICATION

This application claims priority to and the benefit of U.S. Provisional Application No. 62/239,694, entitled "SYSTEM AND METHOD FOR VOLTAGE AND CIRCUIT SENSING AND COMPENSATION IN AN ELECTRONIC DISPLAY," filed Oct. 9, 2015, and U.S. Provisional Application No. 62/305,941, entitled "SYSTEM AND METHODS FOR INDIRECT THRESHOLD VOLTAGE SENSING IN AN ELECTRONIC DISPLAY," filed Mar. 9, 2016, which are hereby incorporated by reference in its entirety for all purposes.

BACKGROUND

This disclosure relates to indirect threshold voltage sensing in display panels. More specifically, the current disclosure provides systems and methods that indirectly sense threshold voltages of pixel circuitry using multiple current or voltage measurements.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Many electronic devices include electronic displays. As display resolutions increase, additional pixels may be placed within a display panel. Threshold voltage (e.g., Vth) shifts among pixels of the electronic displays may cause pixel non-uniformity, resulting in image quality degradation.

Vth changes in a display may be caused by many different factors. For example, Vth changes may be caused by temperature changes of the display, an aging of the display (e.g., aging of the thin-film-transistors (TFTs)), display processes, component manufacturing defects, and many other factors.

To counter-act image degradation caused by Vth shifting, it may be desirable to implement compensation for the Vth shifting. However, as a number of pixels in display devices increase, processing time and memory availability to determine and compensate for Vth may become more and more limited. For example, compensating for varying Vth values on individual pixels may become burdensome on the display system. Further, timing constraints for determining Vth values and compensating for the Vth values may result in timing limitations on compensation circuits.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

To improve image quality and consistency of a display, compensation circuitry may be used to counter-act negative artifacts cause by threshold voltage (Vth) variations throughout a collection of pixels in the display. In the current embodiments, Vth values may be determined based on indirect current or charge sensing techniques. In such a manner, the negative artifacts provided by Vth variations may be avoided by compensating for the Vth variations through columns of pixels rather than at an individual pixel level. For example, indirectly calculated Vth values may be used in compensation logic that adjusts columns of pixels within the display based upon the Vth values that are received by the compensation logic.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

This disclosure relates to near-real time compensation for threshold voltage (Vth) shifts, light-emitting diode (LED) (e.g., organic LEDs (OLEDs)) voltage (Voled) shifts, and/or LED (e.g., organic LEDs (Oleds)) current (Ioled) shifts that may occur in display panels. More specifically, the current embodiments describe techniques for re-using many components of a display panel's circuitry to provide external-to-the-pixel measurement of Vth, Voled, and/or Ioled. These measurements may be provided to compensation logic that alters display output based upon shifts in the Vth, Voled, and/or Ioled.

Figure 1:
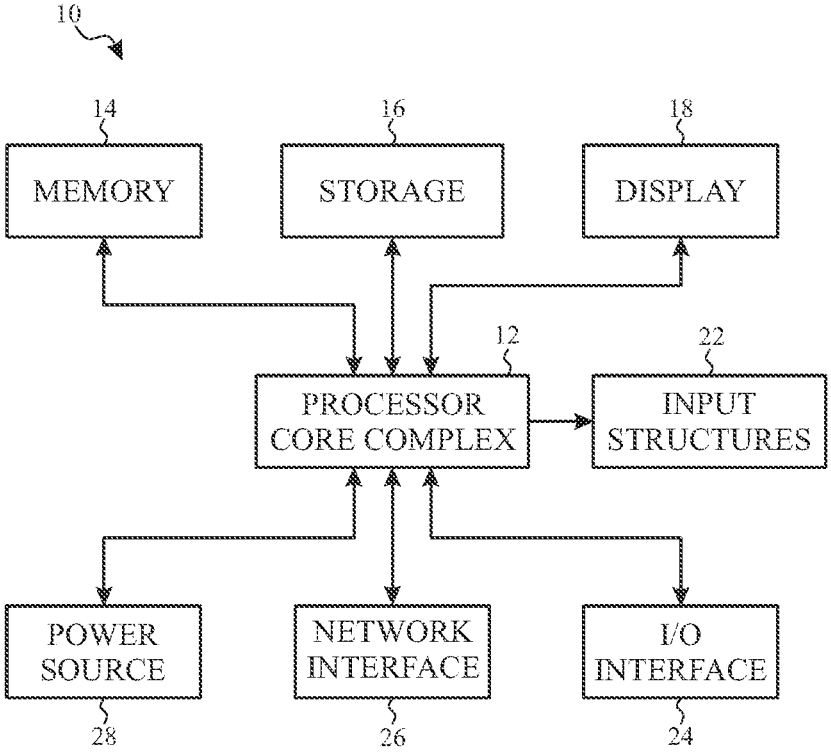
FIG. 1 is a schematic block diagram of an electronic device including a display, in accordance with an embodiment.

Turning first to FIG. 1, an electronic device 10 according to an embodiment of the present disclosure may include, among other things, a processor core complex 12 having one or more processor(s), memory 14, nonvolatile storage 16, a display 18 input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
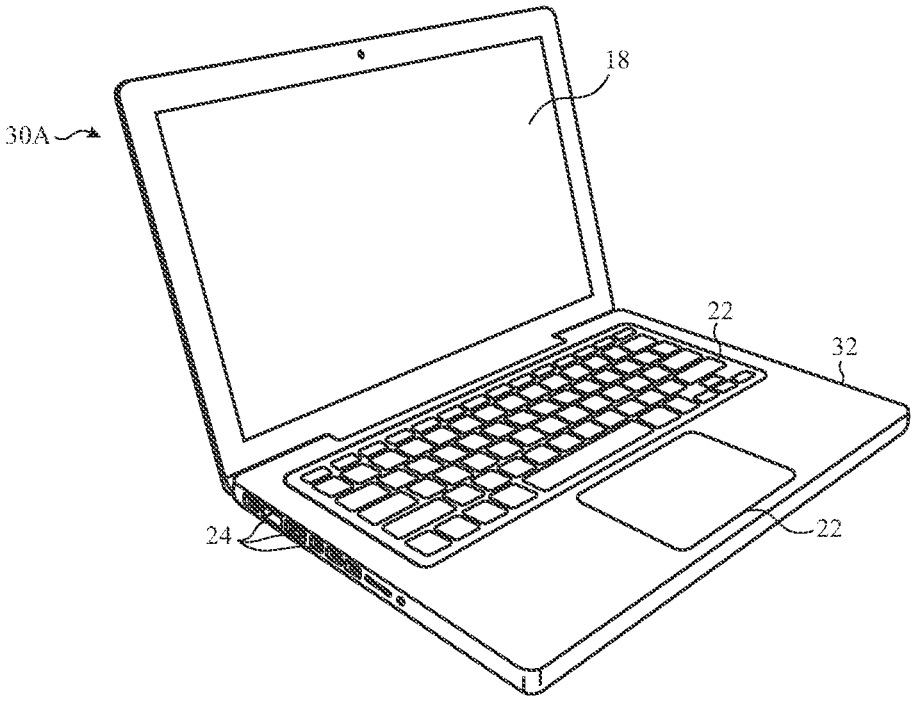
FIG. 2 is a perspective view of a notebook computer representing an embodiment of the electronic device of FIG. 1, in accordance with an embodiment.
Figure 3:
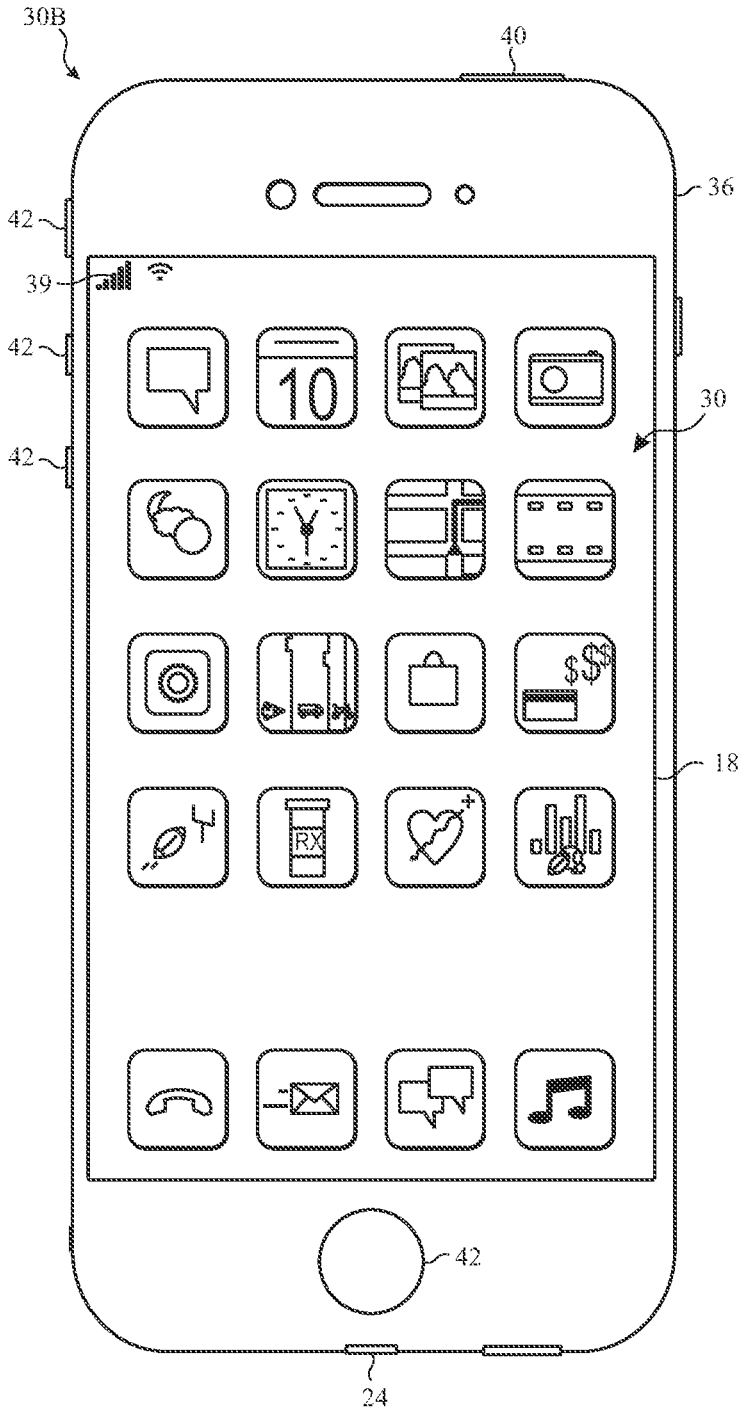
FIG. 3 is a front view of a hand-held device representing another embodiment of the electronic device of FIG. 1, in accordance with an embodiment.
Figure 4:
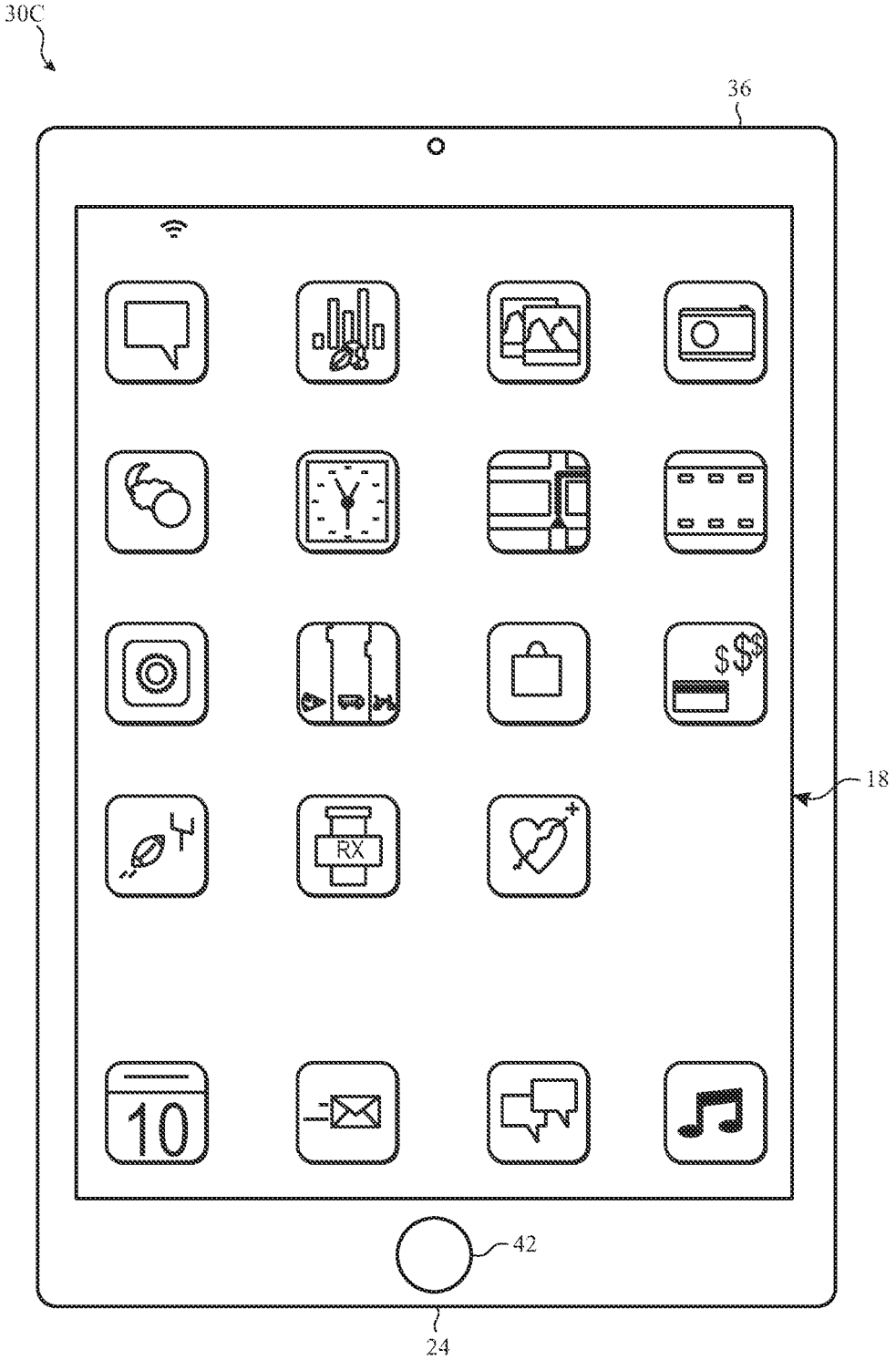
FIG. 4 is a front view of another hand-held device representing another embodiment of the electronic device of FIG. 1, in accordance with an embodiment.
Figure 5:
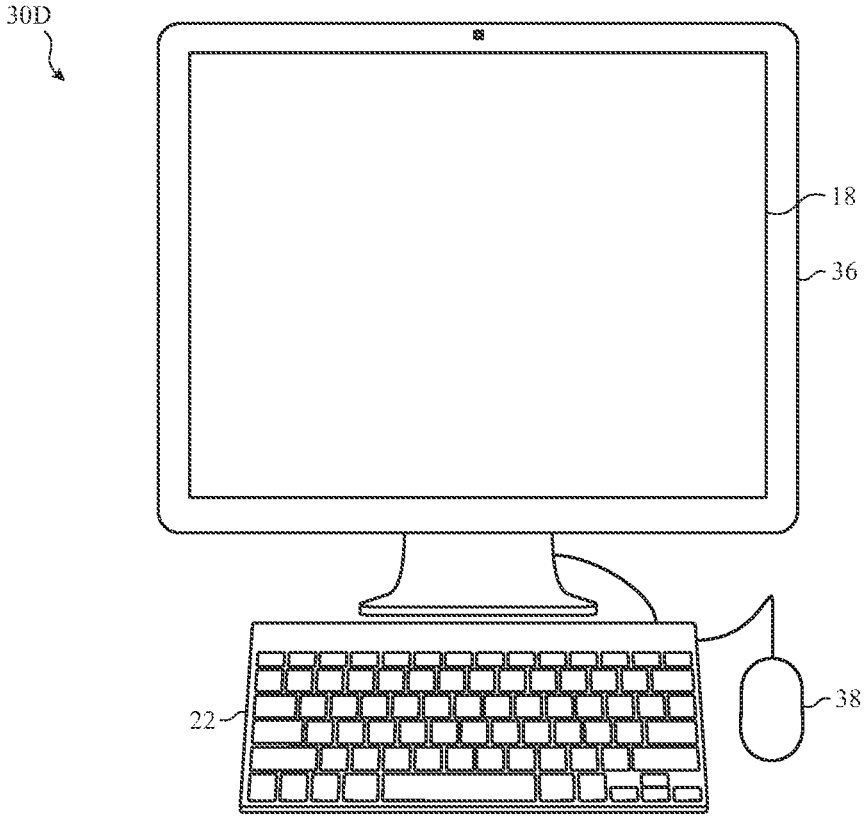
FIG. 5 is a front view of a desktop computer representing another embodiment of the electronic device of FIG. 1, in accordance with an embodiment.

By way of example, the electronic device 10 may represent a block diagram of the notebook computer depicted in FIG. 2, the handheld device depicted in FIG. 3, the desktop computer depicted in FIG. 4, the wearable electronic device depicted in FIG. 5, or similar devices. It should be noted that the processor core complex 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor core complex 12 and/or other data processing circuitry may be operably coupled with the memory 14 and the nonvolatile storage 16 to perform various algorithms. Such programs or instructions executed by the processor core complex 12 may be stored in any suitable article of manufacture that may include one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor core complex 12 to enable the electronic device 10 to provide various functionalities.

As will be discussed further below, the display 18 may include pixels such as organic light emitting diodes (OLEDs), micro-light-emitting-diodes (μ-LEDs), or any other light emitting diodes (LEDs). Further, the display 18 is not limited to a particular pixel type, as the circuitry and methods disclosed herein may apply to any pixel type. Accordingly, while particular pixel structures may be illustrated in the present disclosure, the present disclosure may relate to a broad range of lighting components and/or pixel circuits within display devices.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a $3^{rd}$ generation (3G) cellular network, $4^{th}$ generation (4G) cellular network, or long term evolution (LTE) cellular network. The network interface 26 may also include interfaces for, for example, broadband fixed wireless access networks (WiMAX), mobile broadband Wireless networks (mobile WiMAX), asynchronous digital subscriber lines (e.g., 15SL, VDSL), digital video broadcasting-terrestrial (DVB-T) and its extension DVB Handheld (DVB-H), ultra Wideband (UWB), alternating current (14) power lines, and so forth.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of an I/O interface 24. In one embodiment, the input structures 22 (such as a keyboard and/or touchpad) may be used to interact with the computer 39, such as to start, control, or operate a GUI or applications running on computer 39. For example, a keyboard and/or touchpad may allow a user to navigate a user interface or application interface displayed on display 18.

FIG. 3 depicts a front view of a handheld device 30B, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 42, in combination with the display 18, may allow a user to control the handheld device 30B. For example, the input structure 40 may activate or deactivate the handheld device 30B, the input structure 42 may navigate user interface to a home screen, a user-configurable application screen, and/or activate a voice-recognition feature of the handheld device 30B, the input structures 42 may provide volume control, or may toggle between vibrate and ring modes. The input structures 42 may also include a microphone may obtain a user's voice for various voice-related features, and a speaker may enable audio playback and/or certain phone capabilities. The input structures 42 may also include a headphone input may provide a connection to external speakers and/or headphones.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (PC) by another manufacturer. A similar enclosure 36 may be provided to protect and enclose internal components of the computer 30D such as the display 18. In certain embodiments, a user of the computer 30D may interact with the computer 30D using various peripheral input devices, such as the input structures 22 or mouse 38, which may connect to the computer 30D via a wired and/or wireless I/O interface 24.

Figure 6:
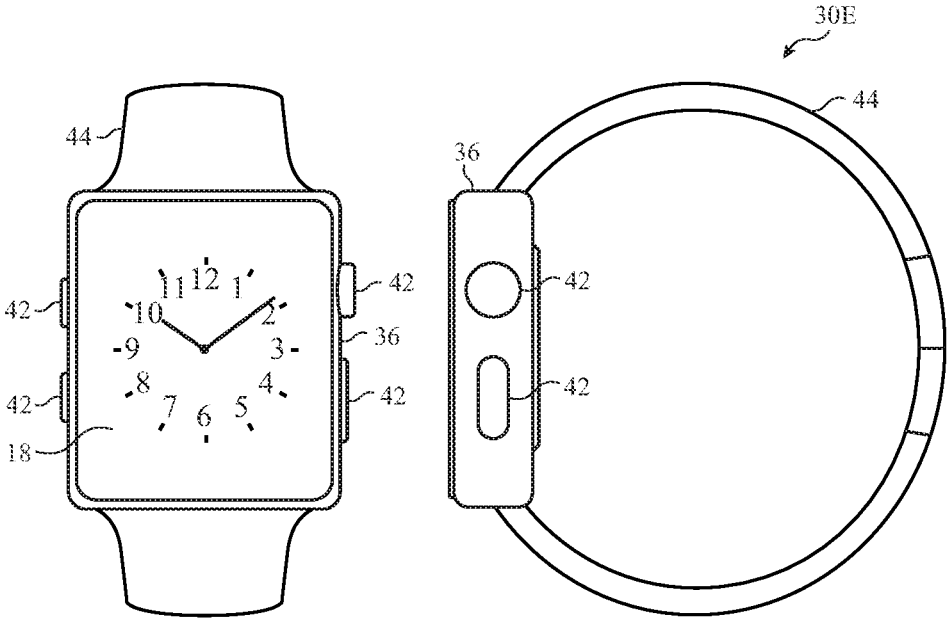
FIG. 6 is a front view of a wearable electronic device representing another embodiment of the electronic device of FIG. 1, in accordance with an embodiment.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen, which may allow users to interact with a user interface of the wearable electronic device 30E.

Figure 7:
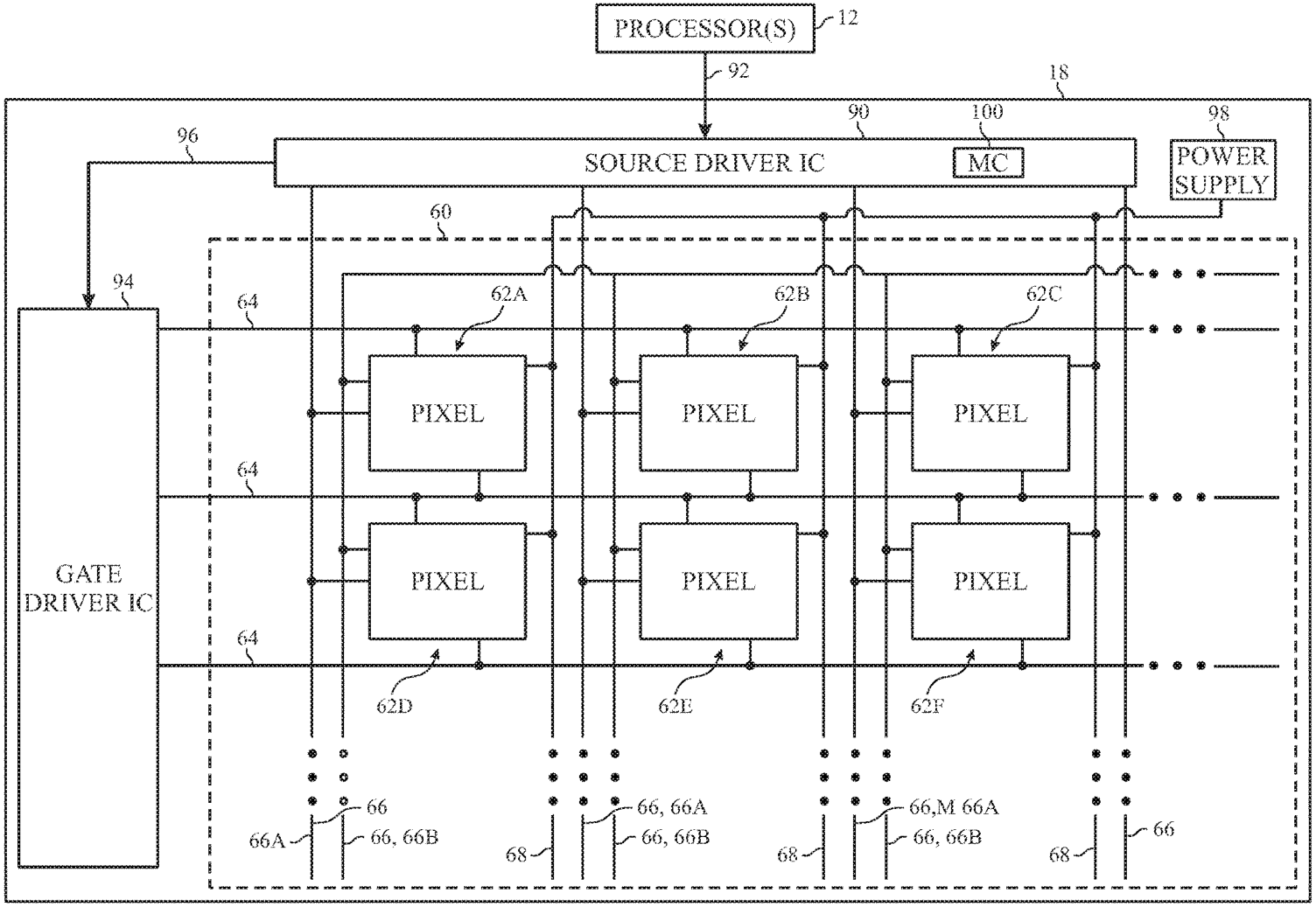
FIG. 7 is a circuit diagram illustrating a portion of a matrix of pixels of the display of FIG. 1, in accordance with an embodiment.

The display 18 for the electronic device 10 may include a matrix of pixels that contain light emitting circuitry. Accordingly, FIG. 7 illustrates a circuit diagram including a portion of a matrix of pixels of the display 18. As illustrated, the display 18 may include a display panel 60. Moreover, the display panel 60 may include multiple unit pixels 62 arranged as an array or matrix defining multiple rows and columns of the unit pixels 62 that collectively form a viewable region of the display 18 in which an image may be displayed. In such an array, each unit pixel 62 may be defined by the intersection of rows and columns, represented here by the illustrated gate lines 64 (also referred to as "scanning lines") and data lines 66 (also referred to as "source lines"), respectively. Additionally, power supply lines 68 may provide power to each of the unit pixels 62.

Although only six unit pixels 62, referred to individually by reference numbers 62*a*, 62*b*, 62*c*, 62*d*, 62*e*, and 62*f*, respectively, are shown, it should be understood that in an actual implementation, each data line 66 and gate line 64 may include hundreds or even thousands of such unit pixels 62. By way of example, in a color display panel 60 having a display resolution of 1024×768, each data line 66, which may define a column of the pixel array, may include 768 unit pixels, while each gate line 64, which may define a row of the pixel array, may include 1024 groups of unit pixels with each group including a red, blue, and green pixel, thus totaling 3072 unit pixels per gate line 64. By way of further example, the panel 60 may have a resolution of 480×320 or 960×640. In the presently illustrated example, the unit pixels 62*a*, 62*b*, and 62*c* may represent a group of pixels having a red pixel (62*a*), a blue pixel (62*b*), and a green pixel (62*c*). The group of unit pixels 62*d*, 62*e*, and 62*f* may be arranged in a similar manner. Additionally, in the industry, it is also common for the term "pixel" may refer to a group of adjacent different-colored pixels (e.g., a red pixel, blue pixel, and green pixel), with each of the individual colored pixels in the group being referred to as a "sub-pixel."

The display 18 also includes a source driver integrated circuit (IC) 90, which may include a chip, such as a processor or ASIC, configured to control various aspects of the display 18 and panel 60. For example, the source driver IC 90 may receive image data 92 from the processor core complex 12 and send corresponding image signals to the unit pixels 62 of the panel 60. The source driver IC 90 may also be coupled to a gate driver IC 94, which may be configured to provide/remove gate activation signals to activate/deactivate rows of unit pixels 62 via the gate lines 64. The source driver IC 90 may include a timing controller that determines and sends timing information 96 to the gate driver IC 94 to facilitate activation and deactivation of individual rows of unit pixels 62. In other embodiments, timing information may be provided to the gate driver IC 94 in some other manner (e.g., using a timing controller that is separate from the source driver IC 90). Further, while FIG. 7 depicts only a single source driver IC 90, it should be appreciated that other embodiments may utilize multiple source driver ICs 90 to provide image signals to the unit pixels 62. For example, additional embodiments may include multiple source driver ICs 90 disposed along one or more edges of the panel 60, with each source driver IC 90 being configured to control a subset of the data lines 66 and/or gate lines 64.

In operation, the source driver IC 90 receives image data 92 from the processor core complex 12 or a discrete display controller and, based on the received data, outputs signals to control the unit pixels 62. When the unit pixels 62 are controlled by the source driver IC 90, circuitry within the unit pixels 62 may complete a circuit between a power supply 98 and light elements of the unit pixels 62. Additionally, to measure operating parameters of the display 18, measurement circuitry 100 may be positioned within the source driver IC 90 to read various voltage and current characteristics of the display 18, as discussed in detail below.

Figure 8:
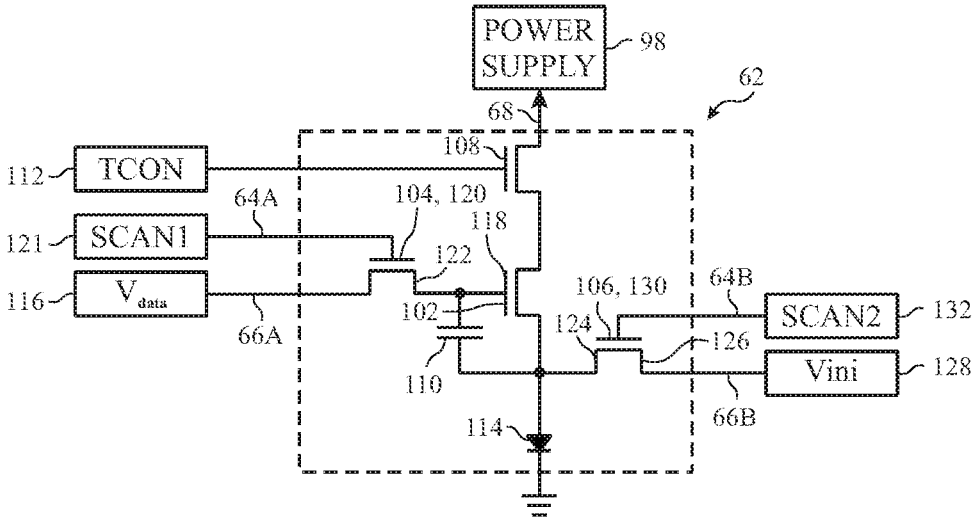
FIG. 8 is a circuit diagram illustrating an organic light emitting diode pixel capable of operating in the matrix of pixels of FIG. 7, in accordance with an embodiment.

With this in mind, FIG. 8 is a schematic diagram of the unit pixel 62 in an OLED display 18. The unit pixel 62 includes a driving thin-film transistor (TFT) 102, two scanning TFTs 104 and 106, an emitter TFT 108, and a storage capacitor 110 in a 4T1C pixel configuration. In the illustrated embodiment, the source emitter TFT 108 may couple between the power supply 98 and the driving TFT 102. In this manner, the emitter TFT 108, which may receive a control signal from a timing controller 112, controls the application of the power supply to the driving TFT 102. Similarly, the driving TFT 102 may be electrically coupled between the emitter TFT 108 and an organic light emitting diode (OLED) 114. Accordingly, the driving TFT 102 controls the application of the power supply from the emitter TFT 108 to the OLED 114. Furthermore, the scanning TFT 104 may be electrically coupled between a data line 66*a*, which carries a data voltage (Vdata) 116, and a gate 118 of the driving TFT 102. A gate 120 of the scanning TFT 104 may be electrically coupled to a first gate line 64*a*, which may receive a first scanning signal 121 from the gate driver IC 94. Each of the TFTs 102, 104, 106, and 108 function as switching elements and may be activated and deactivated (e.g., switched on and off) for a predetermined period based upon the respective presence or absence of a gate activation signal (also referred to as a scanning signal) at the gates of the TFTs 102, 104, 106, and 108.

Furthermore, a storage capacitor 110 may be electrically coupled to a drain 122 of the scanning TFT 104 and a drain 124 of the scanning transistor 106. A source 126 of the scanning TFT 106 may be electrically coupled to a second data line 66B, which carries an initialization voltage (Vini) 128. Further, a gate 130 of the scanning TFT 106 may be coupled to a second gate line 64*b*, which may receive a second scanning signal 132 from the gate driver IC 94.

To display the image data 92, the source driver IC 90 and the gate driver IC 94, as depicted in FIG. 7, may respectively supply voltage to the scanning TFT 104 to charge the storage capacitor 110. The storage capacitor 110 may drive the gate 118 of the driving TFT 102 to provide a current from the power supply 98 to the OLED 114 of the unit pixel 62. As may be appreciated, the color of a particular unit pixel depends on the color of the corresponding OLED 114. The above-described process may be repeated for each row of pixels 62 in the panel 60 to reproduce image data 92 as a viewable image on the display 18. Additionally, it may be appreciated that while FIG. 8 depicts the OLED 114, any other type of lighting element may also be used in place of the OLED 114 for the methods described herein.

By way of example, the first scanning signal 121 may generally control when the data line 66*a* is applied to the driving TFT 102, and, in turn, when the power supply 98 is supplied to the OLED 114. Additionally, the second scanning signal 132 may generally control when the capacitor 110 and the OLED 114 couple to the second data line 66B. Through control of the TFTs 102, 104, 106, and 108, the measurement circuitry 100 may observe various operating parameters of the unit pixels 62, as discussed in detail below.

Charge Sensing Overview

Figure 9:
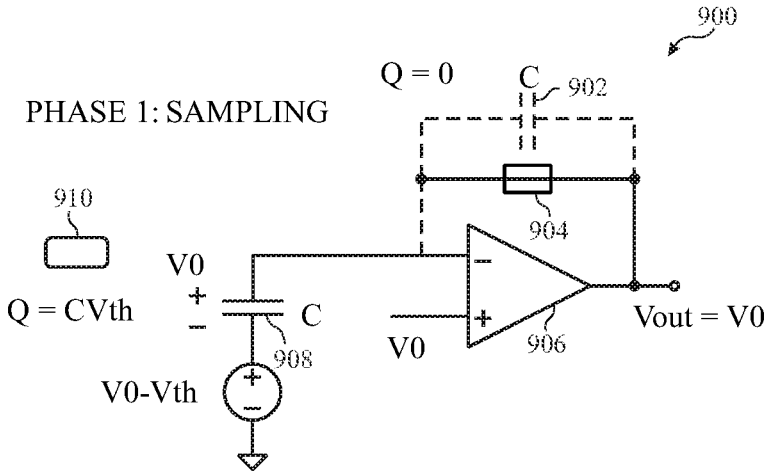
FIG. 9 is a schematic diagram, illustrating a sampling phase 900, in accordance with an embodiment.
Figure 10:
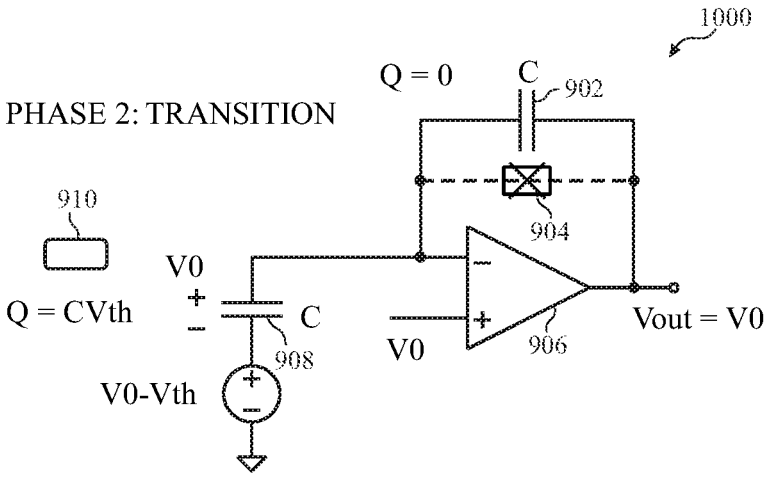
FIG. 10 is a schematic diagram, illustrating a transition phase 1000, in accordance with an embodiment.
Figure 11:
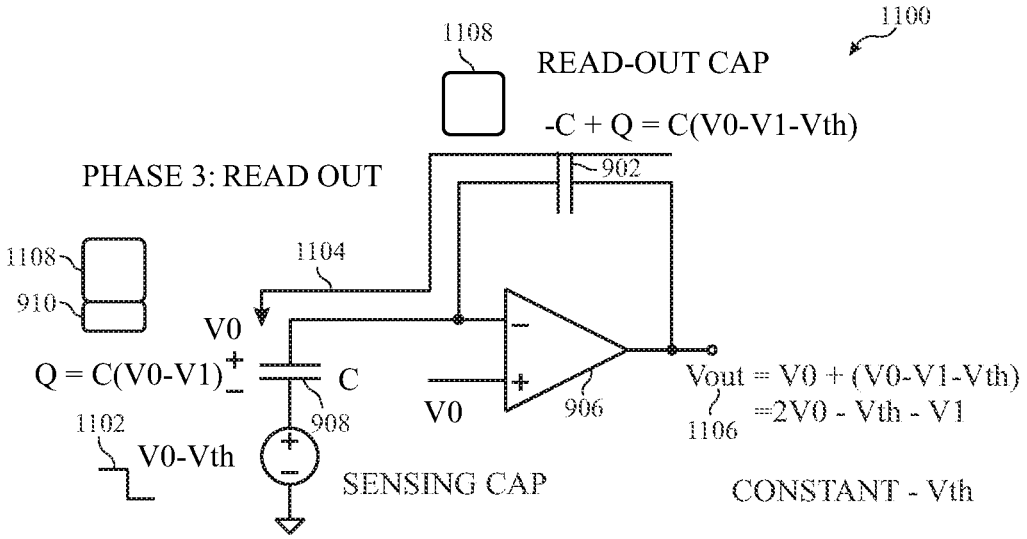
FIG. 11 is a schematic diagram, illustrating a read out phase 1100, in accordance with an embodiment.

Turning now to a discussion of charge sensing, FIGS. 9-11 illustrate three basic phases to complete charge sensing. FIG. 9 illustrates a sampling phase 900, FIG. 10 illustrates a transition phase 1000, and FIG. 11 illustrates a read out phase 1100. Each of these figures will be discussed together, for clarity.

In the sampling phase 900, a capacitor 902 is shorted (e.g., via a switch 904). Accordingly, the output voltage Vout of an amplifier 906 may equal V0. Thus, the top plate of a capacitor 908 may be V0 as well. The bottom plate of the capacitor 908 may equal V0-Vth (the threshold voltage). Accordingly, a charge of the capacitor 908 may be represented as Q=CVth. This initial charge is represented by box 910.

In the transition phase 1000, the short of the capacitor 902 is removed (e.g., by opening the switch 904). In this phase 1000, there are no signal changes, so the voltages remain constant with phase 900. As illustrated, the charge represented by box 910 remains constant.

However, in phase 1100, a step down voltage 1102 is applied, resulting in the bottom plate voltage going lower to V1. The charge of the capacitor 908 may, thus, be represented as Q=C(V0−V1). When this step down occurs, a current 1104 flows from the capacitor 902. The top plate of capacitor 908 is equal to the left plate of capacitor 902. Accordingly, additional charge 1108 may be present. The charge of the capacitor 902 may, thus, be represented by Q=C(V0−V1−Vth). Further, the voltage output (Vout) 1106 may be represented as Vout=V0+(V0−V1−Vth)=2V0−Vth−V1. Because V0 and V1 are known, this equation may be solved for Vth.

As will be discussed in more detail below, the charge sensing techniques described in phases 900-1100 of FIGS. 9-11 may be used to obtain operational parameters on existing display circuitry with relatively few hardware modifications.

Threshold Voltage Sensing Via Vini Line—A First Technique

Turning now to a discussion of techniques for measuring threshold voltage (Vth) using a line (e.g. source line 66B) carrying the Vini voltage 128, FIGS. 12-15 illustrate a progression of phases of pixels 62 useful to determine Vth. FIG. 15A provides a timing diagram of the phases of FIGS. 12-15. For clarity, each of these FIGS. will be discussed together.

Figure 12:
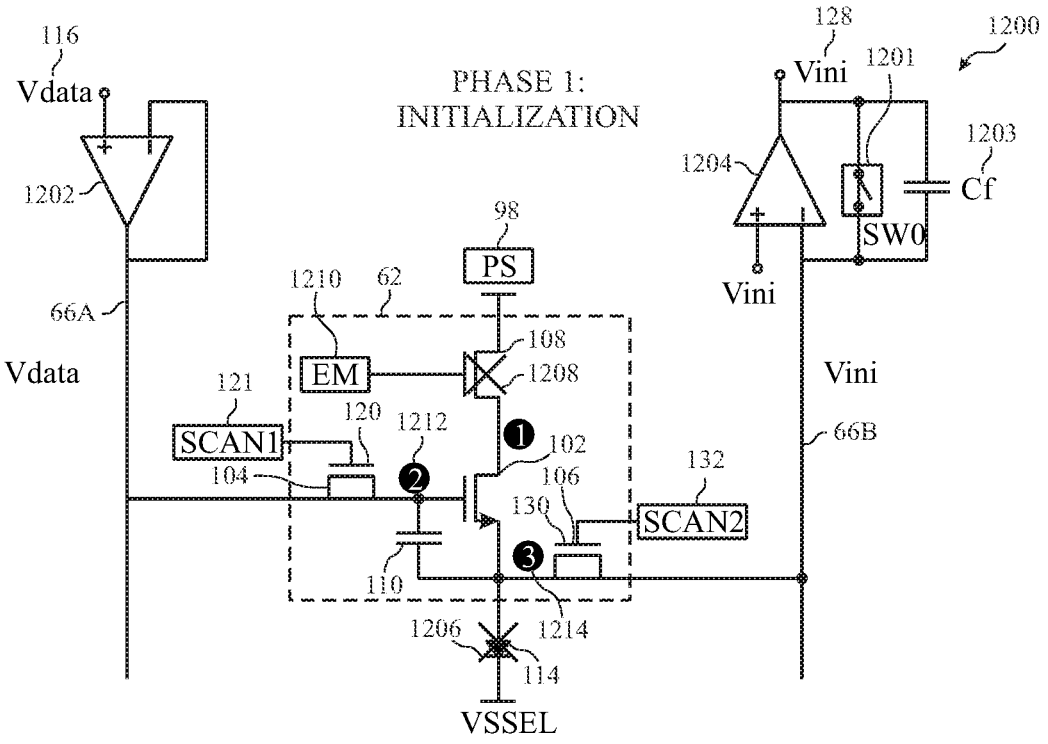
FIGS. 12-15 are schematic diagrams, illustrating a progression of phases of pixels 62 useful to determine Vth, in accordance with certain embodiments.

In a first phase 1200, depicted in FIG. 12, pixel initialization may be implemented. During this phase 1200, a first amplifier 1202 may provide a Vdata voltage 116 on line 66*a*. Further, a second amplifier 1204 may provide a Vini voltage 128 on line 66B. First scanning signal 121 may be connected (e.g., via gate 120). Further, second scanning signal 132 may be connected (e.g., via gate 130). A switch (SW0) 1201 may short a feedback capacitor (Cf) 1203. Accordingly, the Vdata voltage 116 may propagate through the TFT 104 and the Vini voltage 128 may propagate through the TFT 106. The Vini voltage 128 may be low, such that the OLED 114 may be off (as indicated by the X 1206). Further, the timing controller 112 may set the emitter TFT 108 to OFF (as indicated by X 1208) via the emission signal 1210, disconnecting the power supply 98.

In FIG. 15A, column PH1 illustrates the timing of the first scanning signal 121, the second scanning signal 132, the emission signal 1210, and a switching signal for switch 1201. Further, voltage values are symbolized for second node 1212 and third node 1214. As indicated, second node 1212 is equal to the propagated Vdata voltage 116. The third node 1214 is equal to the propagated Vini voltage 128.

Figure 13:
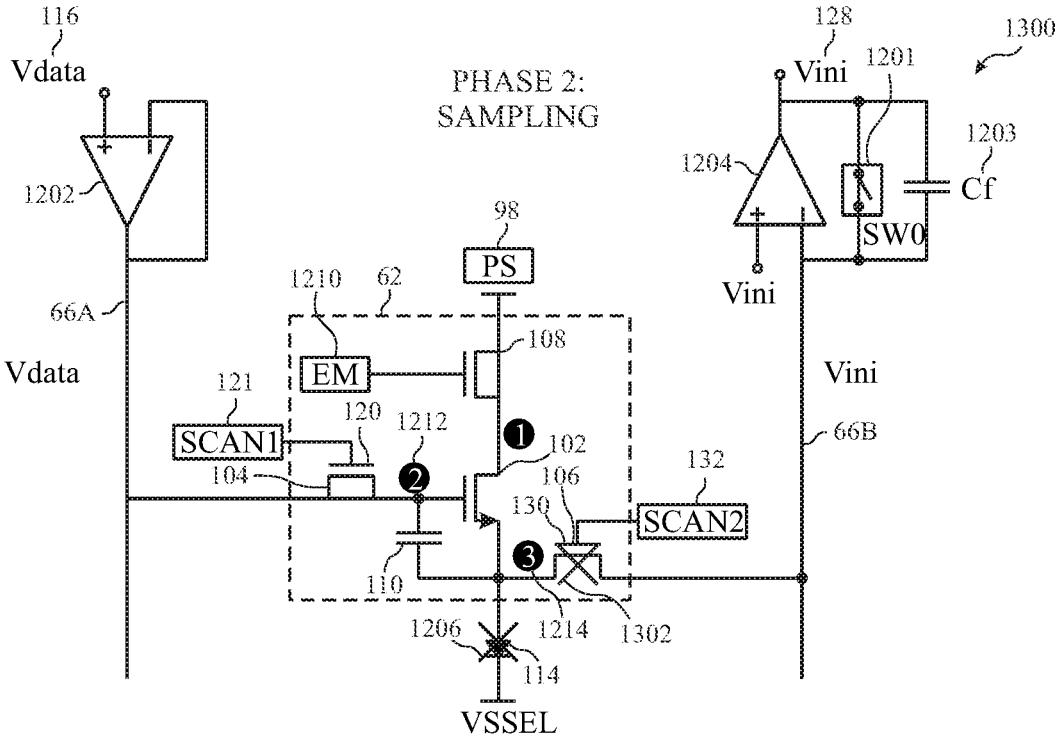

Turning now to a second phase 1300 of FIG. 13, the second phase may initiate sampling in the unit pixel 62. In this phase 1300, the second scanning signal 132 may be disconnected (as indicated by the X 1302). Further, the driving transistor 102 may be coupled with the power supply 98 by turning on the emission signal 1210, which results in turning the emitter TFT 108 ON. As illustrated in the timing diagram 1504, in phase 1300, the signals other than the second scanning signal 132 and the emission signal 1210 remain consistent with the signals of phase 1200. However, by providing a low signal to the gate 130 OFF (e.g., via providing a low signal as the second scanning signal 132, resulting in turning TFT 106 OFF) and turning the TFT 108 ON (e.g., via turning on the emission signal 1210), the third node 1214 increases to equal the propagated Vdata voltage 116 minus Vth. The voltage at the third node 1214 (Vdata−Vth) may be low enough, such that the OLED 114 remains OFF (as illustrated by the X 1206). Thus, no visible light may be seen at the OLED 114.

Figure 14:
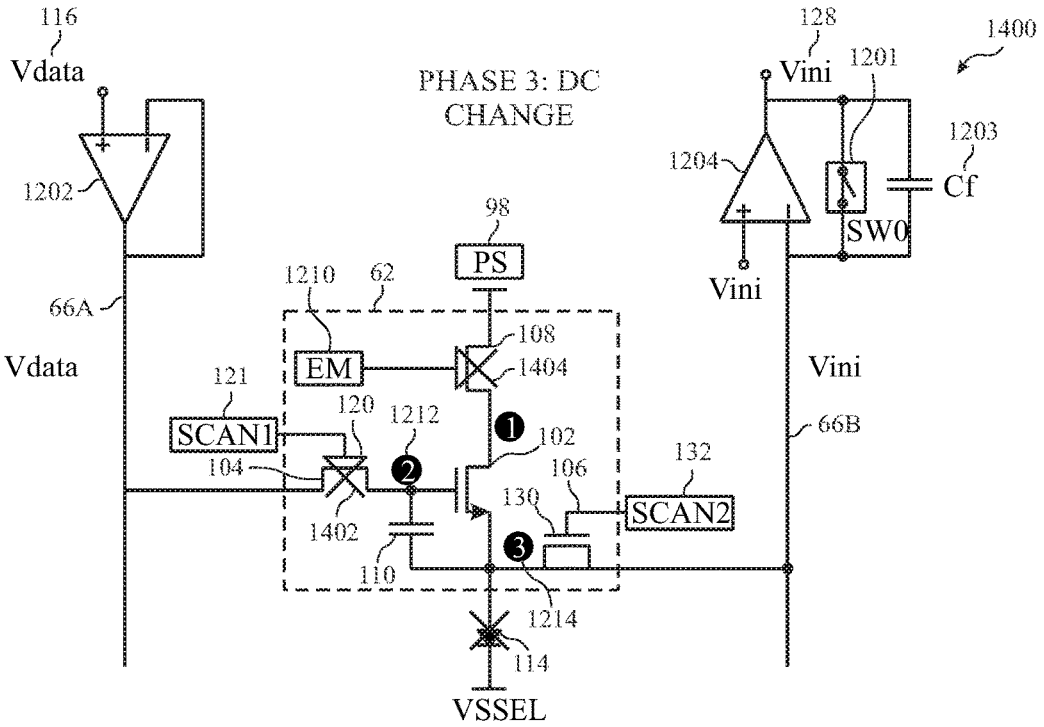

Turning now to a third phase 1400 of FIG. 14, a DC change phase may occur. In this phase 1400, the first scanning signal 121 is a low logic signal, as indicated by X 1402. The second scanning signal 132 is a high logic signal. The emission signal 1210 is a low logic signal, resulting in emitter TFT 108 being turned OFF, as indicated by X 1404. The switch 1201 remains closed, shorting the feedback capacitor Cf 1203. With these settings, the second node 1212 voltage drops from Vdata voltage 116 to Vini voltage 128 plus Vth. Further, the voltage of the third node 1214 transitions to Vini 128.

In some embodiments, Vth may be calculated using the voltages of node 2 1212 and node 3 1214 at this phase 1400. However, to remove parasitic capacitance, the Vth is propagated through the next phase 1500, where the second node 1212 transitions to Vdata 116.

Figure 15:
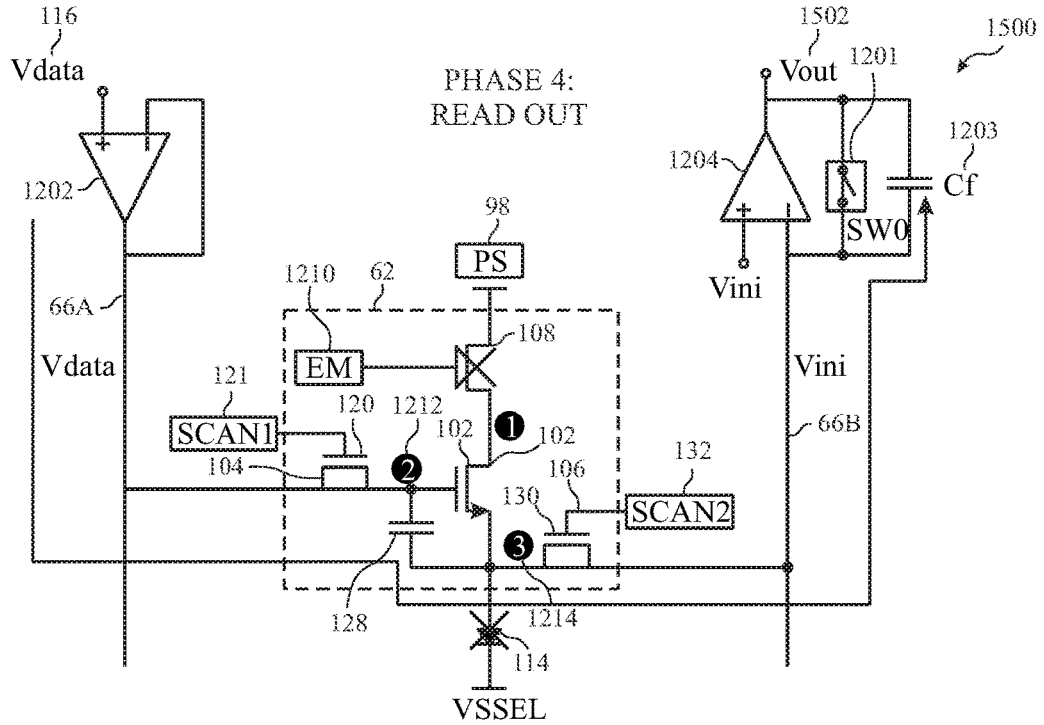
Figure 15A:
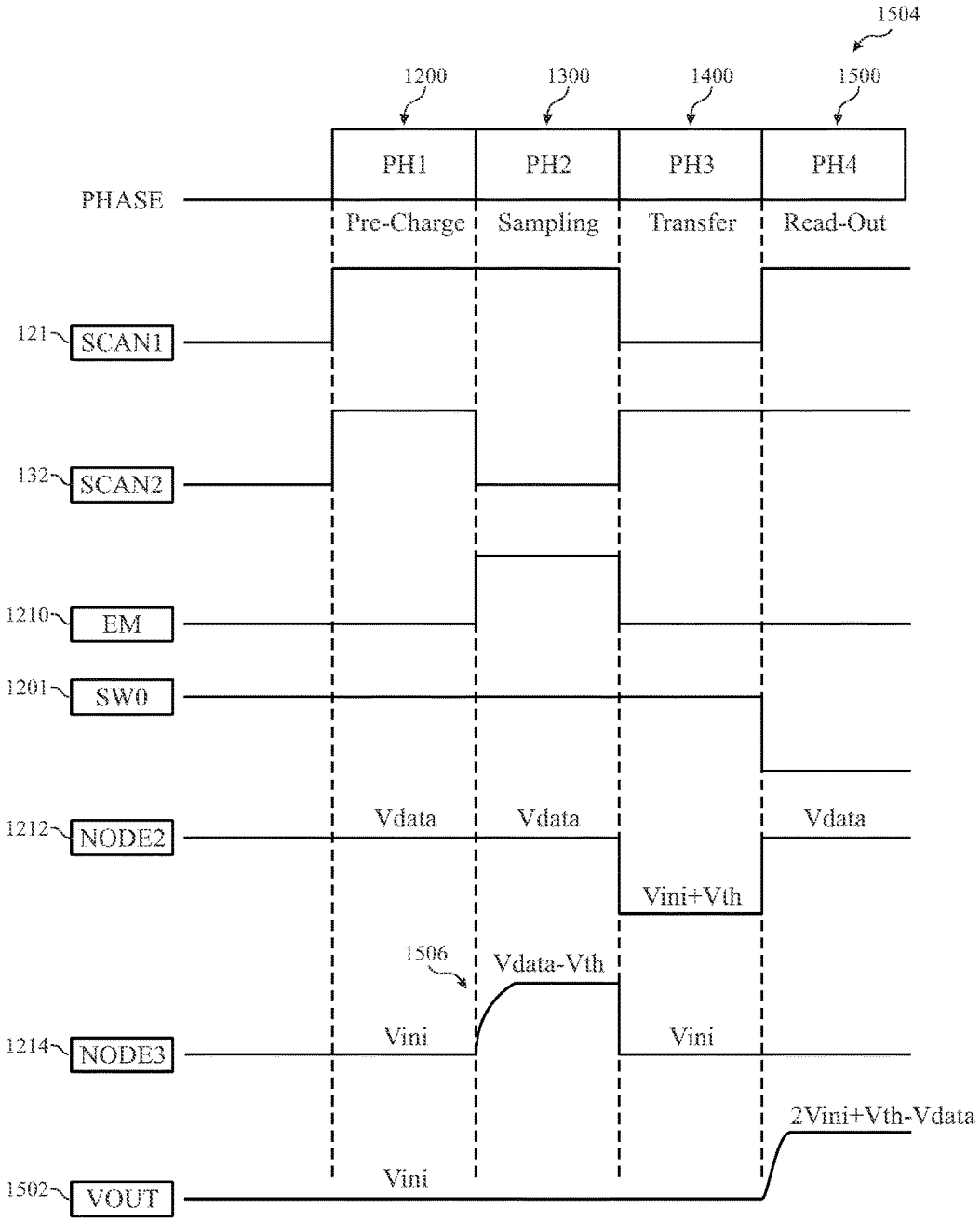
FIG. 15A is a schematic diagram, illustrating a timing diagram of the phases of FIGS. 12-15, in accordance with an embodiment.

In a final readout phase 1500 of FIG. 15, the first scanning signal 121 is a high logic signal. Accordingly, the second node 1212 transitions to Vdata 116. Further, the second scanning signal 132 remains high. Additionally, the emission signal 1210 remains low. Further, the switch 1201 is opened, removing the short of the capacitor 1203. Accordingly, as illustrated in FIG. 15A, the third node transitions to Vini 128. Further, a voltage output (Vout) 1502 transitions to Vini−(Vdata−Vini−Vth) or 2Vini+Vth−Vdata. Because Vini 128 and Vdata 116 are known constants, the Vout 1502 may be used to determine the Vth.

The Vini signal 128 may be a global initialization signal used across an entire display 18 panel. Accordingly, in such embodiments, Vth values for only one pixel may be read at a time. In some embodiments, additional Vini signals 128' may be used to read out Vth values more efficiently. For example, separate Vini signals 128' may be provided per column of pixels in the display 18. However, such embodiments may still not provide parallel Red, Green, and Blue read outs, because the Vini signals 128' may be shared for red columns, shared for blue columns, and shared for green columns. Further, these embodiments may utilize timeout blanking periods to power the pixels and to receive the read out information, which may reduce efficiency.

As may be appreciated, reading the Vth signal over the Vini line (e.g., line 66B) may provide several benefits. For example, this technique may be easily calibrated, as the reference values (e.g., Vdata 116 and/or Vini 128) are known constants that may be used to single out the Vth value. Accordingly, Vth shift calibrations may be implemented without significant processing constraints.

Further, such techniques of using charge transfers may be used across a variety of pixel circuitry types. For example, while the current embodiments of FIGS. 12-15 illustrate a 4T1C (4 transistor, 1 capacitor) unit pixel 62 circuit, the current techniques may be utilized on a number of other pixel circuitry types.

Additionally, the current techniques may utilize existing hardware, reducing additional hardware overhead. For example, existing driving amplifiers may be used in the current techniques. Accordingly, a minimal amount of hardware may be added to the circuitry (e.g., the switch 1201 and capacitor 1203). This added hardware may be added to the timing controller 112, which may be less costly than providing hardware in the unit pixel 62 circuitry and/or the display 18 panel.

Further, because the reference voltages (e.g., Vdata 116 and/or Vini 128) remain constant, the global buses are not toggled. When toggled, the global buses may require a capacitor charge, which may consume additional power. However, since the Vdata 116 and Vini 128 voltages remain constant, the capacitors do not need to be charged, thus the power consumption for determining the Vth using the current techniques may be negligible.

Threshold Voltage Sensing via Vini Line—A Second Technique

Figure 16:
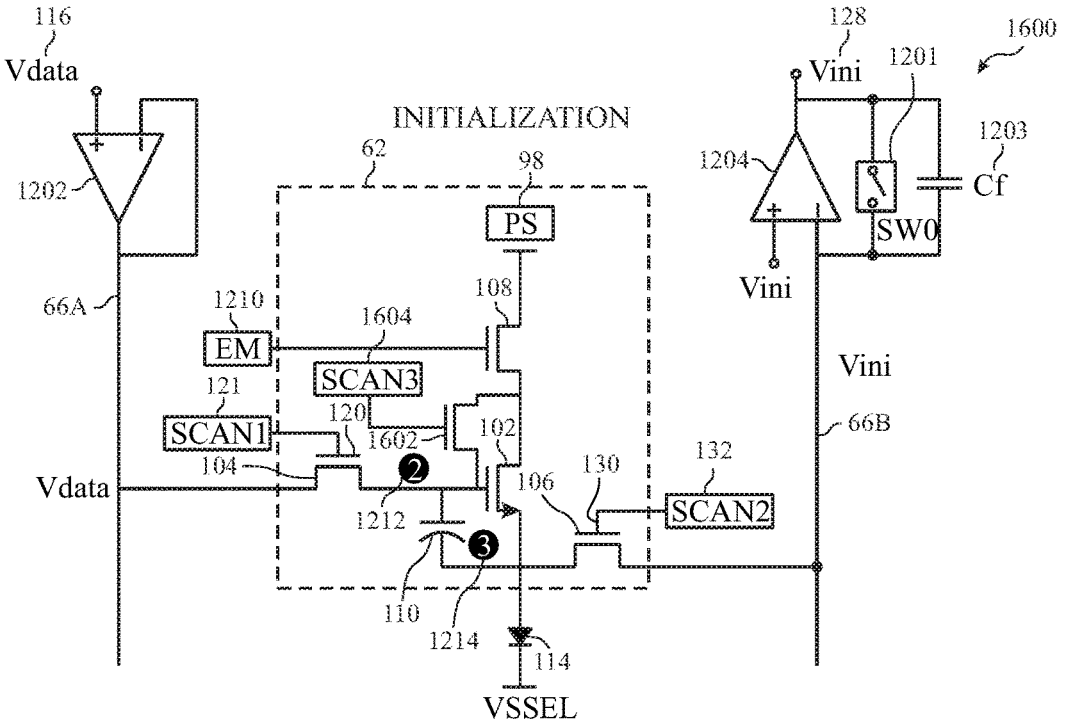
FIG. 16 illustrates an initialization phase, in accordance with an embodiment.
Figure 17:
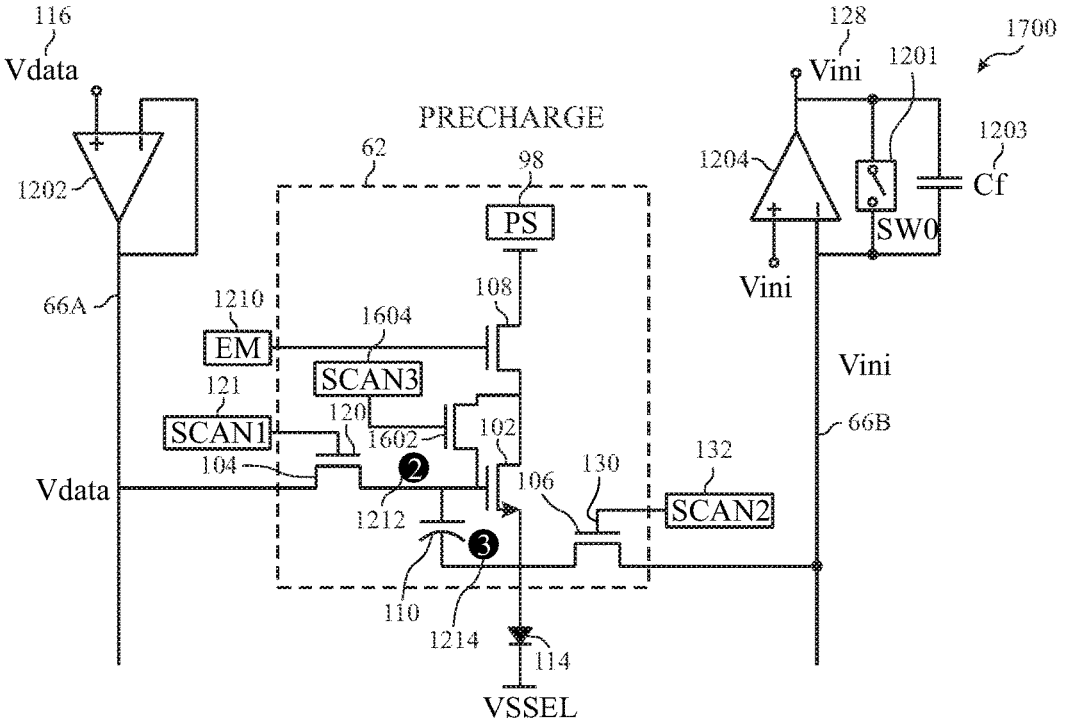
FIG. 17 is a schematic diagram, illustrating a pre-charge phase, in accordance with an embodiment.
Figure 18:
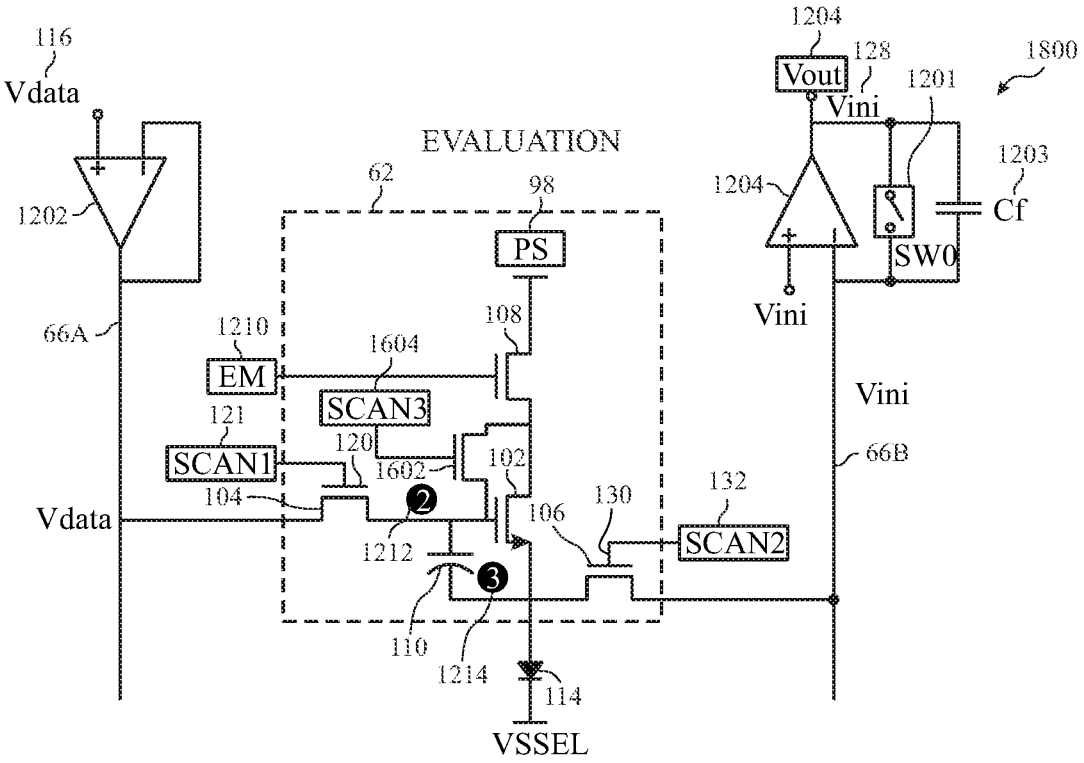
FIG. 18 is a schematic diagram, illustrating an evaluation phase, in accordance with an embodiment.
Figure 19:
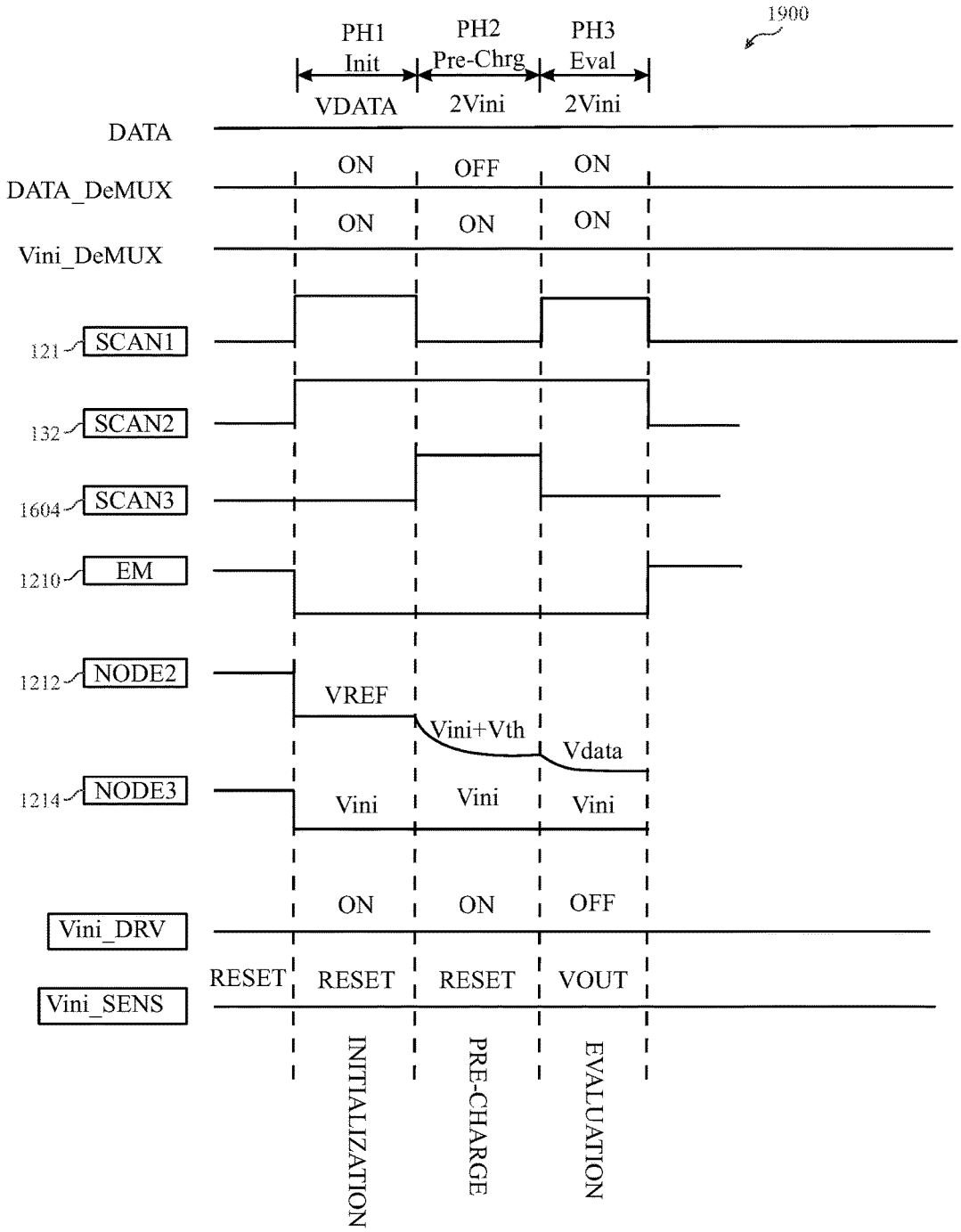
FIG. 19 is a schematic diagram, illustrating a timing diagram for the three phases of FIGS. 17-19, in accordance with an embodiment.
Figure 20:
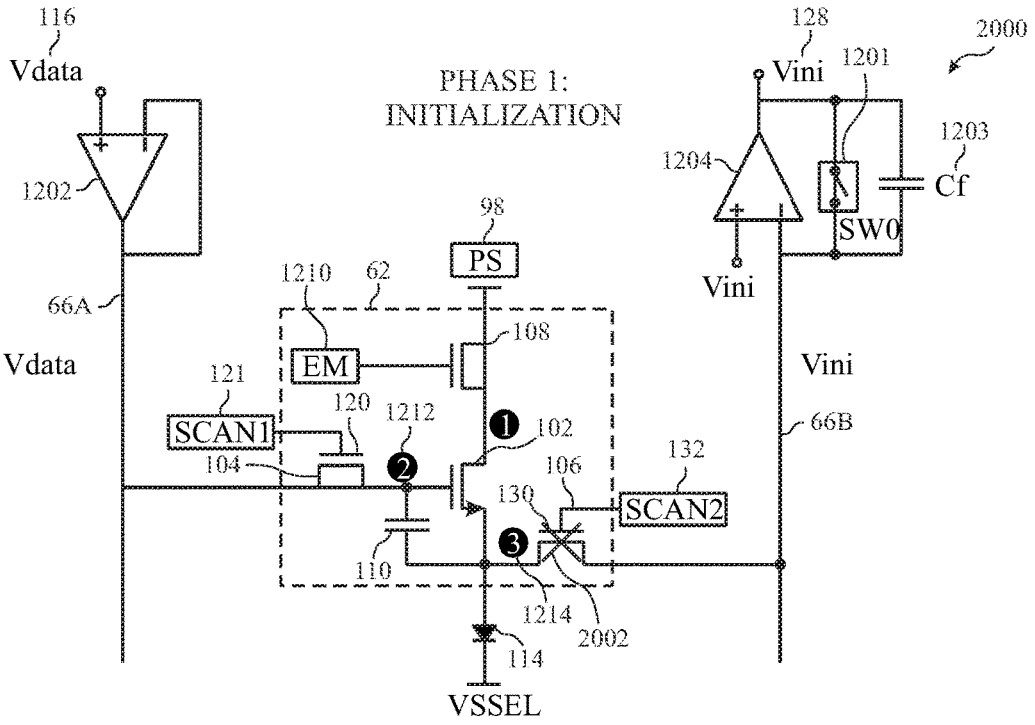
FIGS. 20-23 are schematic diagrams, illustrating phases of a technique for measuring LED (e.g. OLED) voltage (Voled) on the Vini line, in accordance with certain embodiments.
Figure 21:
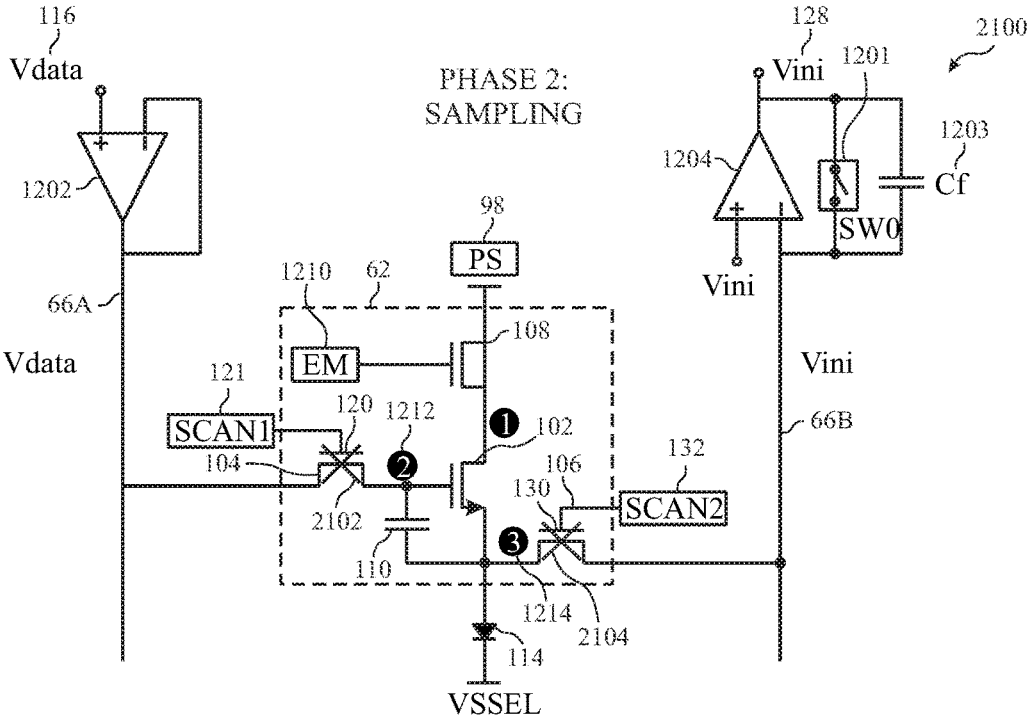
Figure 22:
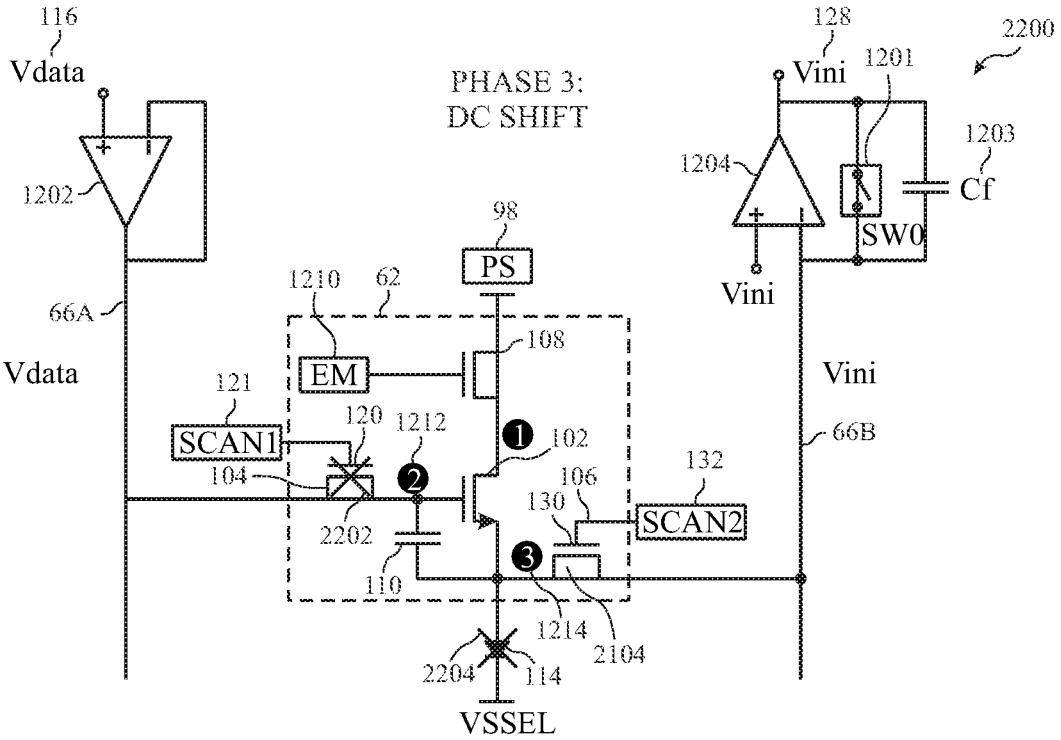
Figure 23:
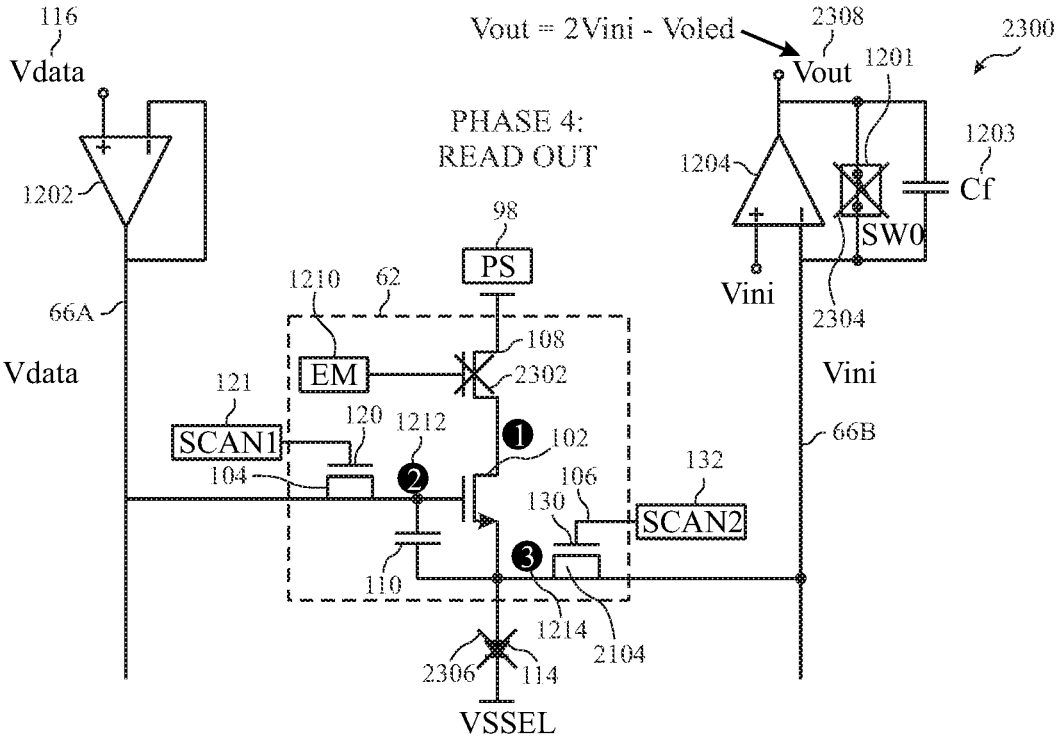

Turning now to a discussion of a second technique for reading out Vth using the Vini line 66B, FIGS. 16-18 illustrate a three-phase (e.g., phases 1600, 1700, and 1800) technique utilizing 5T1C (5 transistors and 1 capacitor) unit pixel 62 circuitry. FIG. 16 illustrates an initialization phase, FIG. 17 illustrates a pre-charge phase, and FIG. 18 illustrates an evaluation phase. FIG. 19 illustrates a timing diagram 1900 for the three phases 1600, 1700, and 1800.

As may be appreciated, the current technique may reduce the number of phases to three phases, as compared to the technique described in FIGS. 12-15A, which includes four phases. However, the current technique also utilizes a third transistor 1602 and a third scanning signal 1604. In general, the third transistor 1602 may create a feedback voltage that may replace the sampling phase 1300 described in FIG. 13.

The initialization phase 1600 of FIG. 17 is very similar to the initialization phase 1200 of FIG. 12. In particular, the first scanning signal 121 and second scanning signal 132 are high logic signals. Further, the third scanning signal 1604 and emitter signal 1210 are low. These settings result in Vdata 116 at the second node 1212. Further, the third node is Vini 128 and remains at Vini 128 for each of the subsequent phases 1700 and 1800.

Moving next to the pre-charge phase 1700 of FIG. 17, the first scanning signal 121 and the emitter signal 1210 may be low, while the second and third scanning signals 132 and 1604 are high logic signals. These changes cause the second node 1212 to transition to Vini 128 minus Vth. In this step, the charge of capacitor 110 may be determined as Q1(Cst)=Cst*(Vref−Vref+Vth)=Cst*Vth.

In some embodiments, Vth may be calculated using the voltages of node 2 1212 and node 3 1214 at this phase 17. However, to remove parasitic capacitance, the Vth is propagated through the next phase, where the second node 1212 transitions to Vdata 116.

In the evaluation phase 1800, the first scanning signal 121 and second scanning signal 132 are high logic signals. The third scanning signal 1604 and the Emitter signal 1210 are low. Further, the switch 1201 may be opened, such that the short of the capacitor 1203 is removed. These changes cause the second node 1212 to drop to Vdata 116. Accordingly, the charge of the capacitor 1203 may be described as Q2(Cst)=Cst*(Vdata−Vini). Similar to above, Vout 1502 may be described as Vout=Vini−(Vdata−Vini−Vth)=2Vini+Vth−Vdata=Constants+Vth.

OLED Voltage Sensing Via Vini Line

Figure 24:
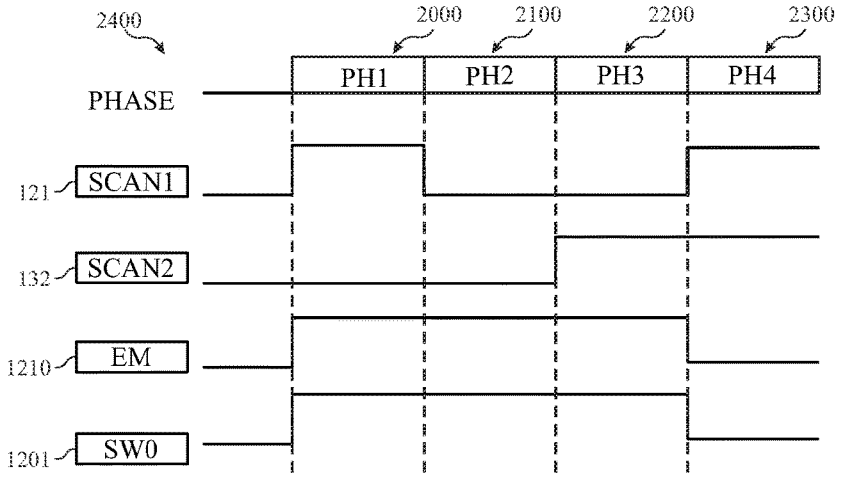
FIG. 24 is a schematic diagram illustrating a timing diagram for the techniques described in FIGS. 20-23, in accordance with an embodiment.

Turning now to a discussion of OLED voltage sensing, FIGS. 20-23 illustrate phases of a technique for measuring LED (e.g. OLED) voltage (Voled) on the Vini line 66B. Further FIG. 24 provides a timing diagram 2400 for the techniques described in FIGS. 20-23. For clarity, these figures will be discussed together.

Starting first with the initialization phase 2000, the first scanning signal 121 and the emitter signal 1210 are high logic signals and the switch 1201 is closed. This results in TFTs 108 and 104 turning ON. TFT 106 is turned OFF (as represented by X 2002). Node 2 1212 is set to Vdata 116 and Node 3 is set to Voled. The OLED 114 is ON.

Turning to the sampling phase 2100, the first scanning signal 121 and second scanning signal 132 are low. The emitter signal 1210 and the switch 1201 remain high, continuing to short the capacitor 1203 and providing voltage to the OLED 114. This results in transistors 104 and 106 turning OFF (as indicated by X's 2102 and 2104. Node 2 1212 becomes Vdata 116. Further, Node 3 1214 becomes Voled. The OLED 114 remains ON.

In the DC shift phase 2200, the first scanning signal 121 is low, turning OFF transistor 104 (as indicated by X 2202). Further, the second scanning signal 132 the emitter signal 1210 are high and the switch 1201 is closed, resulting in continued shorting of the capacitor 1203, and the transistors 108 and 106 to turn ON. The OLED may not be ON (as indicated by X 2204) because the voltage may flow along line 66B. Node 2 1212 becomes voltage Vini 128+Vdata 116−Voled. Node 3 voltage becomes Vini 128.

In the read-out phase 2300, the first scanning signal 121 and second scanning signal 132 are high logic signals. This results in TFTs 104 and 106 turning ON. The emitter signal 1210 is a low logic signal, resulting in transistor 108 turning OFF (as indicated by X 2302). The switch 1201 is opened, removing the short to the capacitor 1203 (as indicated by X 2304). Additionally, as a result of these settings, the OLED 114 does not receive power from the power supply 98 and is, thus, turned OFF (as indicated by X 2306). The voltage output (Vout) 2308 may be calculated as 2Vini−Voled. Accordingly, because Vini 128 is known, Voled may be calculated.

OLED Current Sensing Via Vini Line

Figure 25:
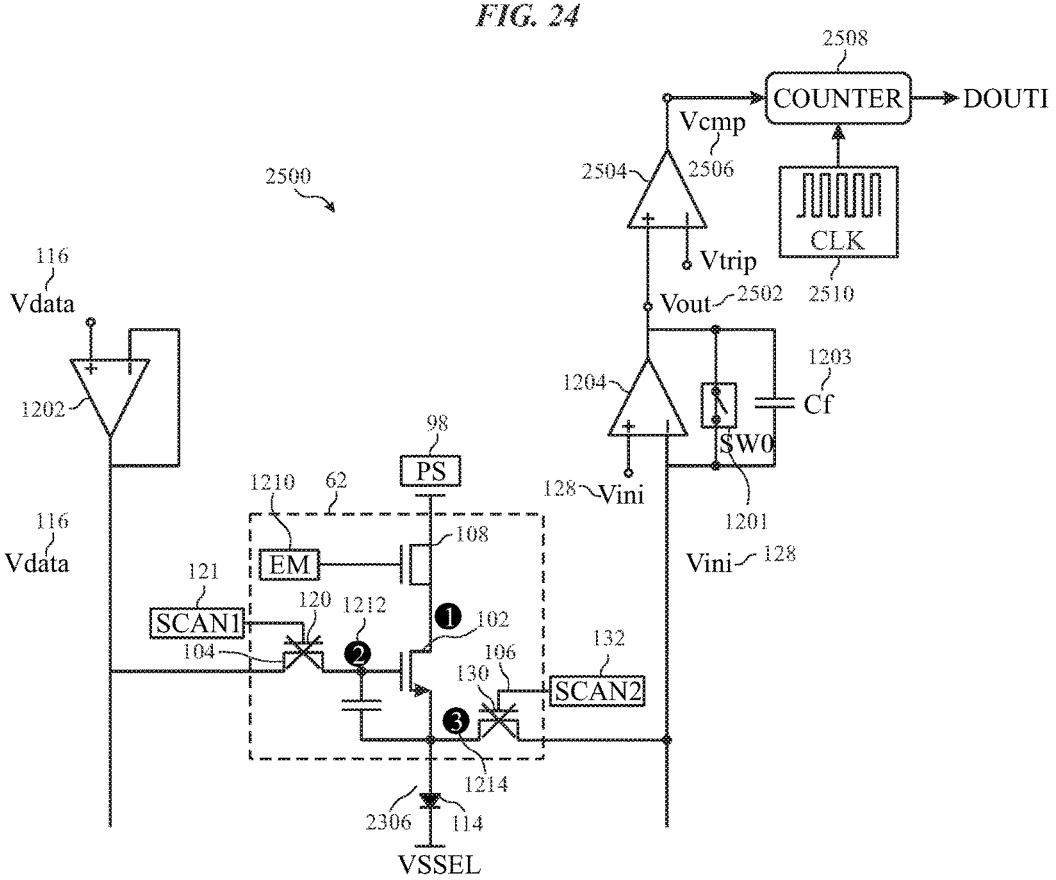
FIG. 25 is a schematic diagram, illustrating a normal operation mode for OLED pixel circuitry 62, in accordance with an embodiment.
Figure 26:
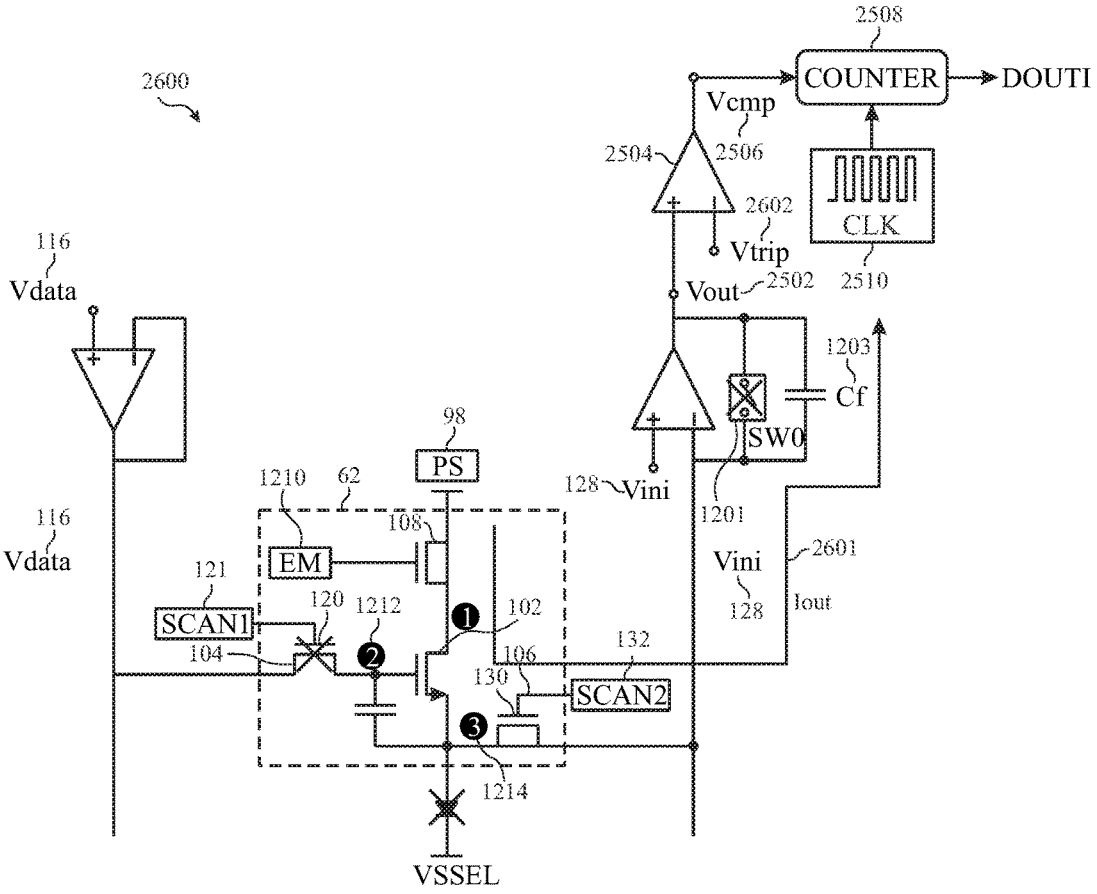
FIG. 26 is a schematic diagram, illustrating sensing parameters of the OLED pixel circuitry that may allow an OLED current to be measured, in accordance with an embodiment.
Figure 27:
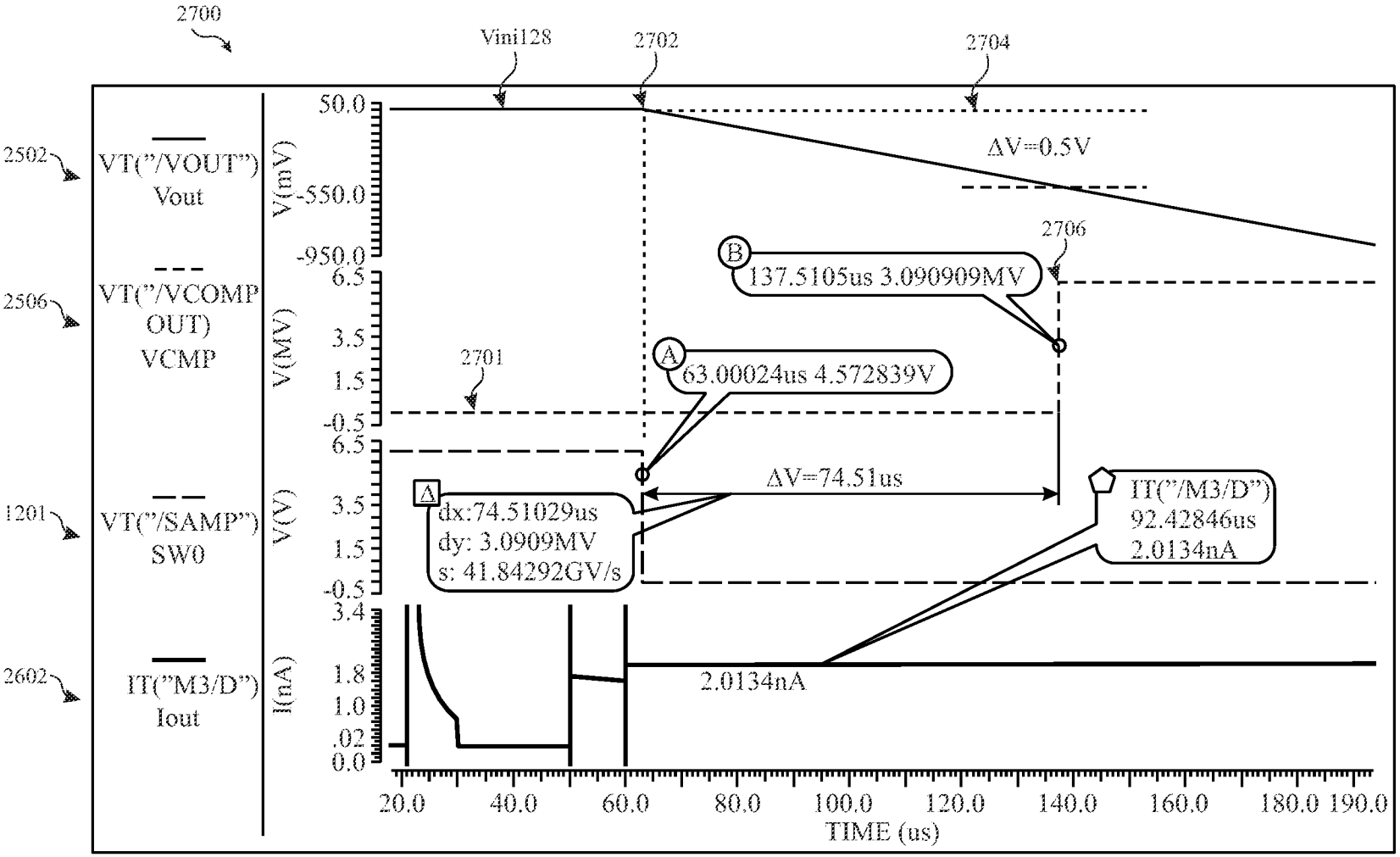
FIG. 27 is a schematic diagram of simulated data, illustrating simulated current sensing, using the techniques described in FIGS. 25 and 26, in accordance with an embodiment.

Turning now to a discussion of LED (e.g., OLED) current sensing (Ioled) via the Vini line 66B, FIG. 25 illustrates a normal operation mode for OLED unit pixel 62 circuitry. FIG. 26 illustrates sensing parameters of the OLED unit pixel 62 circuitry that may allow an OLED current to be measured, using relatively little additional hardware to the display 18 circuitry. FIG. 27 illustrates simulated data, illustrating simulated current sensing, using the techniques described in FIGS. 25 and 26. These figures will be discussed together for clarity.

Starting first with FIG. 25, FIG. 25 illustrates a normal operational mode 2500, where OLED 114 is emitting light. As illustrated in FIG. 25, the TFT 108 is ON, causing voltage to flow from the power supply 98 to the OLED 114. Further, the switch 1201 is closed, shorting the capacitor 1203. The voltage output (Vout) 2502 may be connected to a third amplifier 2504. As discussed in more detail below, the third amplifier 2504 may be used to provide a voltage comparison (Vcmp) 2506, which may be used in conjunction with the counter 2508 and a clock 2510 (e.g. a timing controller clock) to measure the Ioled.

FIG. 26 illustrates a current sensing mode 2600 used to obtain the Ioled value. To obtain the Ioled value, the short to the capacitor 1203 is removed, by opening the switch 1201. Further, the second scanning signal 132 are high logic signals, resulting in voltage flow through the TFT 106. This results in current flow through the path indicated by Iout 2601.

As mentioned above, the third amplifier 2504 may provide a voltage comparison Vcmp 2506. The Vcmp 2506 may compare the Vout 2502 with a pre-defined voltage trip value Vtrip 2602. More specifically, the third amplifier 2504 may provide a first value via Vcmp 2506 when Vout 2502 does not cross Vtrip 2602. However, upon Vout 2502 crossing Vtrip 2602, a second value may be provided via Vcmp 2606.

The relationship between the capacitance (Cf) of the capacitor 1203, the change in voltage (ΔV) between Vout 2502 and Vtrip 2602, the output current (I), and the change in time (Δt) from the provision of the first value and the second value via Vcmp 2506 may be described as follows:

$$\Delta V \times Cf = I \times \Delta t$$

$$I = \Delta V \times Cf / \Delta t$$

As mentioned above, the counter 2508 and clock 2510 may be used in the calculation of Ioled. For example, the counter 2508 may calculate a number of clock cycles of the clock 2510 between Vcmp 2506 transitioning from the first value to the second value after the bout 2601 is provided. In other words, the counter 2508 may count a number of clock cycles between transitioning between Vout 2502 to Vtrip 2602. ΔV may be calculated as Vout 2502−Vtrip 2602. As may be appreciated, Vout 2502 is equal to Vini 128.

Turning now to the simulation 2700 of FIG. 27, the Vout 2502 is initially equal to Vini 128, resulting in a first value 2701 (e.g., a low value) at Vcmp 2506. As the switch 1201 is opened at time 2702, the output current Iout 2601 flows to the capacitor 1203. Accordingly, the Vout 2502 begins to transition downward. When Vout reaches Vtrip 2602 at time 2704 a second value 2706 is output by Vcmp 2506. As illustrated, ΔV may be calculated as 0.5V (e.g., the difference between the Vout 2502 and Vtrip 2602). Additionally, Δt is calculated as 74.5 us (e.g., the difference between times 2704 and 2702). Further, the capacitance Cf of capacitor 1203 may be a known value, such as 0.3 p. Accordingly, using the equation I=ΔV×Cf/Δt, the current may be determined to equal: 0.5V×0.3 p/74.5 u=2.013 nA.

OLED Threshold Voltage Sensing via Vdata Line

Figure 28A:
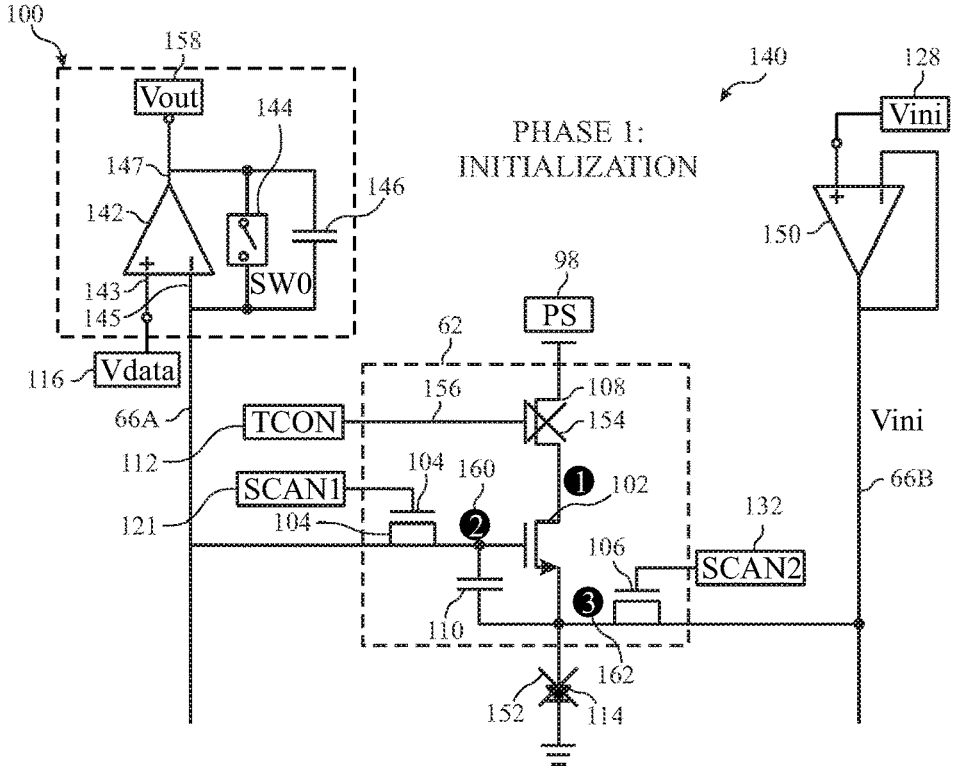
FIG. 28A is a circuit diagram of an initialization phase for measuring a threshold voltage of an organic light emitting diode pixel, in accordance with an embodiment.
Figure 28B:
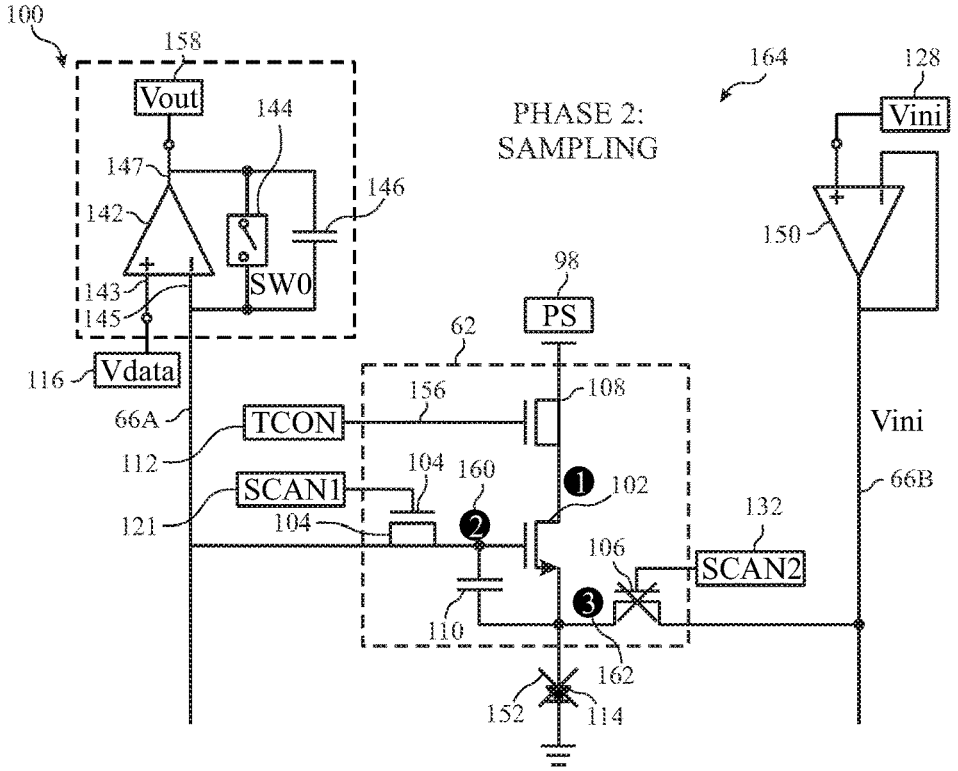
FIG. 28B is a circuit diagram of a sampling phase for measuring the threshold voltage of the organic light emitting diode pixel, in accordance with an embodiment.
Figure 28C:
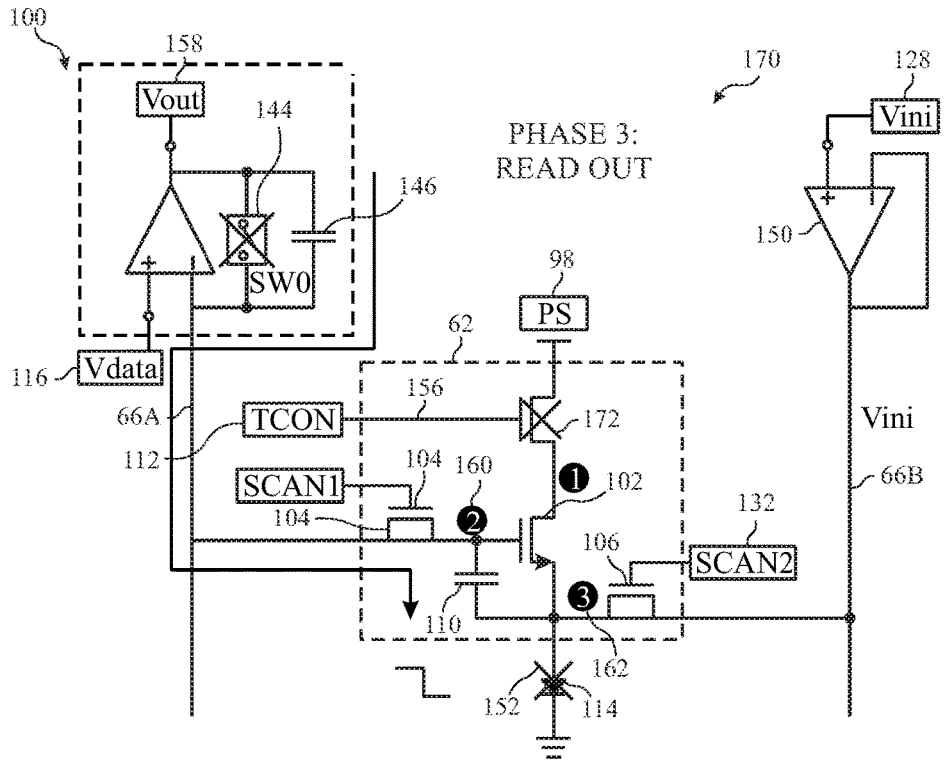
FIG. 28C is a circuit diagram of a readout phase for measuring the threshold voltage of the organic light emitting diode pixel, in accordance with an embodiment.
Figure 28D:
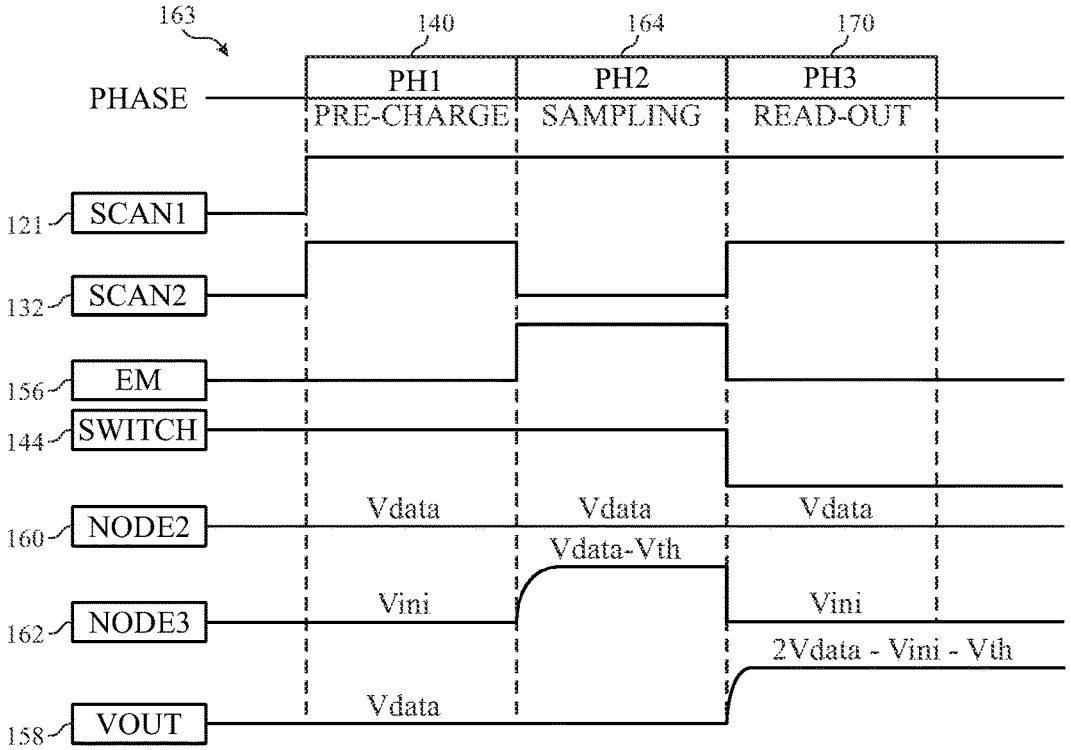
FIG. 28D is a timing diagram of the phases illustrated in FIGS. 28A-28C, in accordance with an embodiment.

Turning now to a discussion of techniques for measuring threshold voltage (Vth) using a line (e.g. source line 66*a*) carrying the Vdata voltage 116, FIGS. 28A-28C illustrate a progression of phases of unit pixels 62 useful to determine Vth. FIG. 28D provides a timing diagram of the phases of FIGS. 28A-28C. For clarity, each of these FIGS. will be discussed together.

During a first phase 140, depicted in FIG. 28A, pixel initialization may be implemented. During the first phase 140, a first amplifier 142 may provide a Vdata voltage 116 on the first data line 66*a*. Additionally, a second amplifier 150 may provide a Vini voltage 128 on the second data line 66B. The first scanning signal 121 may provide a signal to the gate 120 of the scanning TFT 104 to activate the scanning TFT 104. Further, the second scanning signal 132 may provide a signal to the gate 130 of the scanning TFT 106 to activate the scanning TFT 106. A switch 144 may short a feedback capacitor 146 coupled across a negative terminal 145 and an output 147 of the amplifier 142. Accordingly, the Vdata voltage 116 may propagate through the scanning TFT 104, and the Vini voltage 128 may propagate through the gate 130. Additionally, the Vini voltage may be sufficiently low, such that the OLED 114 remains in an OFF state, as indicated by the X 152 over the OLED 114. Further, the timing controller 112 may set the emitter TFT 108 to OFF (as indicated by the X 154) via the emission signal 156, disconnecting the power supply 98 from the unit pixel 62.

In FIG. 28D, column PH1 of a timing diagram 163 illustrates the timing of the first scanning signal 121, the second scanning signal 132, the emission signal 156, Vdata voltage 116, Vini voltage 128, and voltage output (Vout) voltage 158. Further, voltage values are symbolized for second node 160 and third node 162. As indicated, second node 160 is equal to the propagated Vdata voltage 116. The third node 162 is equal to the propagated Vini voltage 128.

Turning now to a second phase 164 of FIG. 28B, the second phase 164 may initiate sampling in the unit pixel 62. In the second phase 164, the second scanning signal 132 may be provide a low signal to the scanning TFT 106 (as indicated by column PH2 of FIG. 28D). Further, the emitter TFT 108 may couple the power supply 98 to the driving TFT 102 when the emission signal 156 is a high signal. As illustrated in the timing diagram 163, in the second phase 164, the signals other than the second scanning signal 132 and the emission signal 156 remain consistent with the signals of the first phase 140. However, by turning the scanning TFT 106 OFF (e.g., via providing a low signal as the second scanning signal 132) and turning the emitter TFT 108 ON (e.g., via providing a high signal as the emission signal 156), the third node 162 becomes equal the propagated Vdata voltage 116 minus a threshold voltage (Vth of the OLED 114. The voltage at the third node 162 (Vdata−Vth) may be low enough, such that the OLED 114 remains OFF (as illustrated by the X 152). Thus, no visible light may be seen at the OLED 114.

Turning now to a third phase 170 of FIG. 28C, a readout phase may occur. In the third phase 170, the first scanning signal 121 remains high, and the second scanning signal 132 becomes a high logic value. The emission signal 156 is a low logic value, resulting in the emitter TFT 108 being turned OFF, as indicated by X 172. The switch 144 is opened, removing the short of the feedback capacitor 146. With these settings, the second node 160 remains at the Vdata voltage 116, and the third node 162 becomes the Vini voltage 128. Accordingly, the Vout voltage 158 transitions to 2 times Vdata voltage 116 minus Vth minus Vini voltage 128 (2Vdata−Vth−Vini). Because Vdata 116, Vini 128, and Vout 158 are known values, Vout=2Vdata−Vth−Vini may be solved for Vth.

Determining the value of Vth along the first data line 66*a* may result in simple calibration of the unit pixel 62. For example, the reference values (e.g., Vdata 116 and/or Vini 128) are known constants that may be used to single out the Vth value. Accordingly, Vth shift calibrations may be implemented without significant processing constraints. Additionally, this charge transfer technique may apply to a number of pixel types that include a capacitor 110. For example, while the current embodiments of FIGS. 28A-28C illustrate a 4T1C (4 transistor, 1 capacitor) unit pixel 62 circuit, the current techniques may be utilized on a number of other pixel circuitry types that include a capacitor.

Additionally, the current techniques may utilize existing hardware, reducing additional hardware overhead. For example, existing driving amplifiers may be used in the current techniques (e.g., driving amplifiers within the timing controller 112 or the source driver IC 90). Accordingly, a minimal amount of hardware may be added to the circuitry (e.g., the switch 144 and capacitor 146). This added hardware may be added to the timing controller 112, which may be less costly than providing hardware in the pixel circuitry 62 and/or the display 18 panel.

Further, because the reference voltages (e.g., Vdata 116 and/or Vini 128) remain constant, the global buses are not toggled. When toggled, the global buses may require a capacitor charge, which may consume additional power. However, since the Vdata 116 and Vini 128 voltages remain constant, the capacitors do not need to be charged, thus the power consumption for determining the Vth using the current techniques may be negligible.

Furthermore, because the Vdata 116 applied to red, green, and blue pixel units 62 is different from color to color (i.e., the red, green, and blue pixels do not always receive the same value of the Vdata 116), the Vth for the red, green, and blue pixel units 62 may be calculated in parallel. Accordingly, there is flexibility in reading out the Vth values for the different color pixel units 62 separately. Therefore, determining the Vth from the first data line 66*a* may increase efficiency for the display 18 as a whole.

Additionally, because the OLED 114 remains OFF during the technique described above, the values of Vdata 116 and Vini 128 may be selected in such a manner that the OLED 114 remains inactive throughout the technique described above. For example, the Vth value, while not known exactly prior to solving for Vth, may be around 1.5V. Accordingly, Vdata 116 may be less than 1.5V and greater than 0V. Additionally, if there is a desired value for Vout 158, then the equation, Vout=2Vdata−Vth−Vini, may be used to solve for Vini 128 when Vth is assumed to be 1.5V. For example, if it is desired for Vout 158 to be 2.5V and Vth is assumed to be 1.5V, then Vdata 116 may be chosen to be 1V and Vini 128 may be −2V.

OLED Voltage Sensing Via Vdata Line—First Method

Figure 29A:
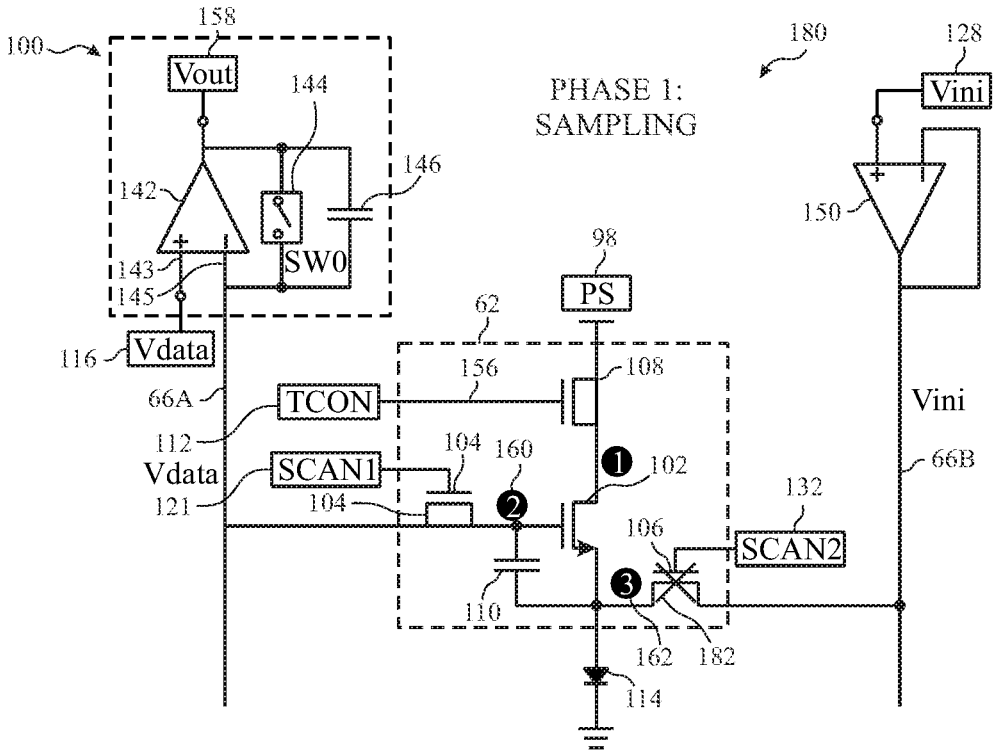
FIG. 29A is a circuit diagram of a sampling phase for measuring an organic light emitting diode voltage of an organic light emitting diode pixel, in accordance with an embodiment.
Figure 29B:
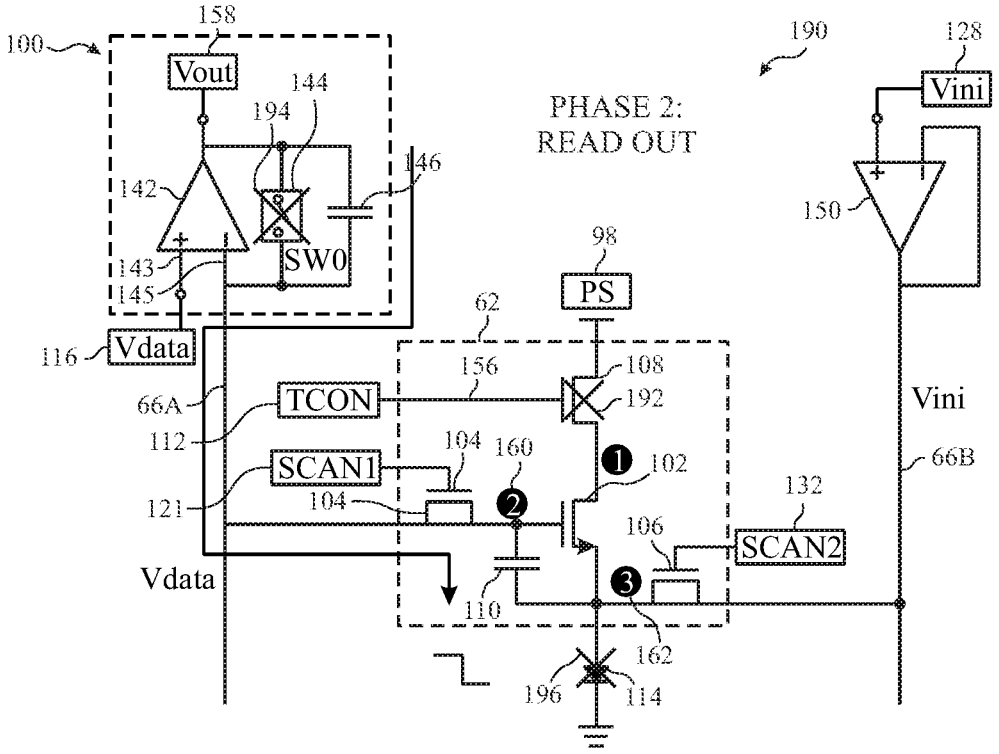
FIG. 29B is a circuit diagram of a readout phase for measuring the organic light emitting diode voltage of the organic light emitting diode pixel, in accordance with an embodiment.
Figure 29C:
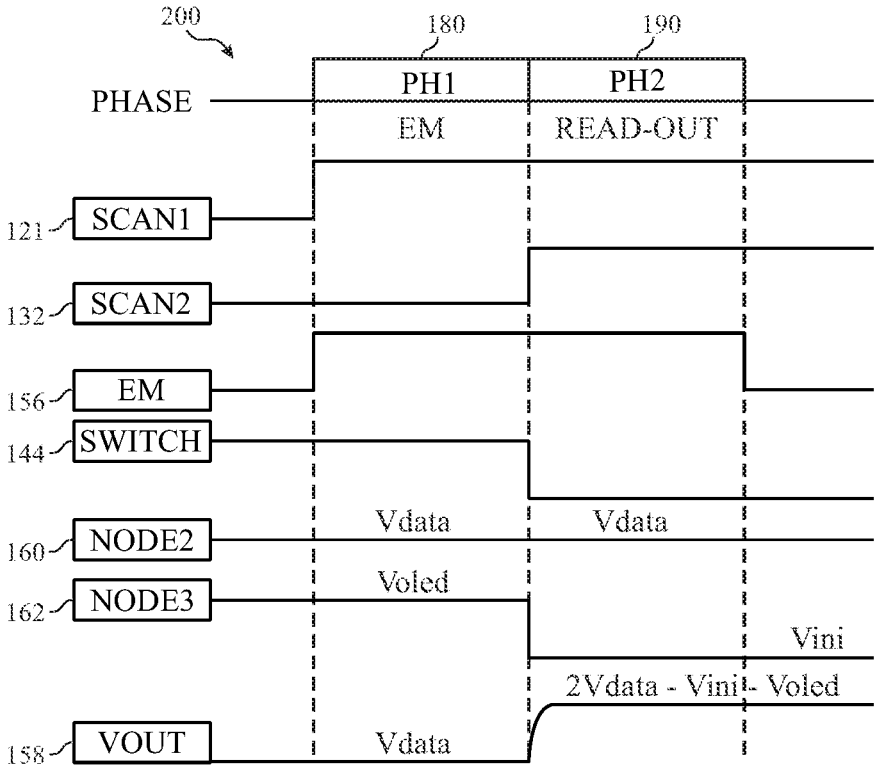
FIG. 29C is a timing diagram of the phases illustrated in FIGS. 29A and 29B, in accordance with an embodiment.

Turning now to a discussion of LED voltage sensing, FIGS. 29A-29B illustrate phases of a technique for measuring LED (e.g. OLED) voltage (Voled) on the first data line 66*a*. Further FIG. 29C provides a timing diagram 200 for the techniques described in FIGS. 29A-29B. For clarity, these figures will be discussed together.

Starting first with the sampling phase 180, the first scanning signal 121 and the emitter signal 156 both have high logic values, and the switch 144 is set to closed. This results in TFTs 108 and 104 turning ON. Additionally, the TFT 106 is turned OFF (as represented by X 182). Accordingly, the second node 160 registers a voltage of Vdata 116 and the third node 162 registers the Voled value. Additionally, the OLED 114 is ON.

Turning to the readout phase 190, the first scanning signal 121 and second scanning signal 132 provide high voltages to the scanning TFTs 104 and 106. Additionally, the emitter signal 156 provides a low signal to the emitting TFT 108 (as represented by X 192) and the switch 144 is opened (as represented by X 194), removing the short around the capacitor 146. By turning the TFT 108 OFF, the OLED 114 no longer receives power from the power supply 98 and is, thus, turned OFF (as represented by X 196). With this configuration, the second node 160 continues to register the voltage of Vdata 116. Further, the voltage of the third node 162 decreases from Voled to Vini 128. Additionally, at this phase, the voltage output (Vout) 158 may be read. To calculate the value of Voled, the value of Vout 158 in this configuration is equal to Vdata−Vini+Voled. Accordingly, because Vout 158, Vdata 116, and Vini 128 are known, Voled may be calculated. Similar to the Vth measurement technique discussed above, the Voled measurement technique provides simple calibration, applies to most pixel circuits, provides parallel readout for red, blue, and green pixel units 62, and consumes a low amount of power.

Additionally, a value of Vdata 116 may be selected in such a manner that Vdata 116 is greater than the Voled value added to the Vth value. The value of Voled plus Vth may be approximately 3.5V depending on the specific OLED 114 used in the pixel unit 62 and the age of the OLED 114. Additionally, the value of Vini 128 may be a value less than 0V, and the value of Vout 158 may be greater than 0V. Accordingly, Vout 158 may be approximately 5.5V when Vdata 116 is selected as slightly greater than 3.5V and Vini is selected as slightly less than 0V.

OLED Voltage Sensing via Vdata Line—Second Method

Figure 30:
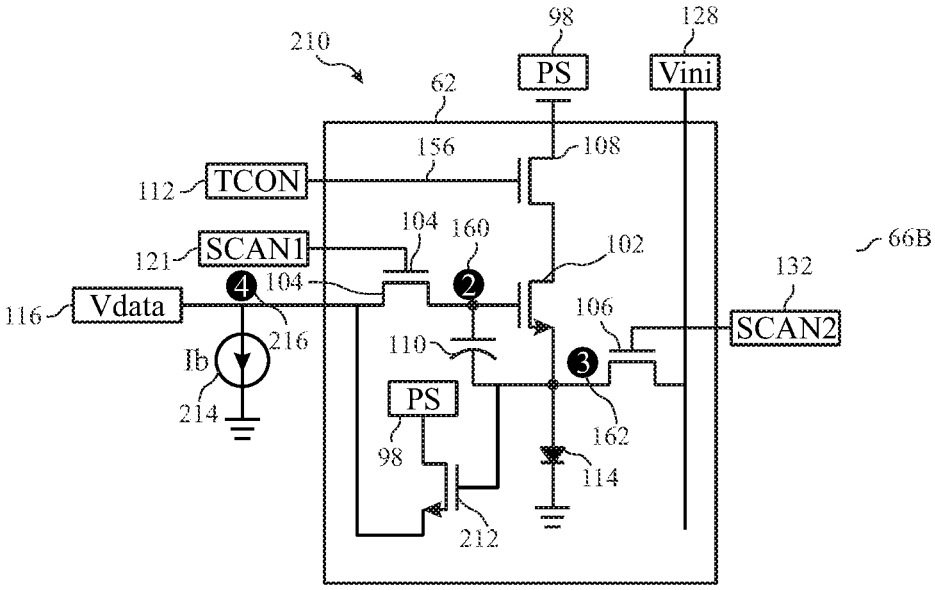
FIG. 30 is a circuit diagram of a second method for measuring the organic light emitting diode voltage of the organic light emitting diode pixel, in accordance with an embodiment.

Turning now to FIG. 30, a pixel unit 62 that uses a second method 210 to measure the Voled value is illustrated. Using the second method 210, a measuring TFT 212 is disposed within the pixel unit 62. During a Vth sensing operation, as described above, the value of Vdata 116 may remain greater than the voltage at the third node 162. Accordingly, the measuring TFT 212 remains in an OFF state. To measure the value of Voled, the Vdata 116 value is pulled down using a current source 214 coupled to a fourth node 216. By pulling down the voltage at the fourth node 216, Vout, measured at the fourth node 216, may equal Voled−Vth+Vod. Vout and Vth have known values. Additionally, Vod is determined from current Ib drawn by the current source 214. Therefore, Voled is the only remaining voltage that is not known, and, thus, the value of Voled may be solved from the equation Vout=Voled−Vth+Vod. Using the second method 210, the value of Voled may be sensed at any time, and efficiency loss of the OLED 114, as measured by changes in the Voled, may be compensated with a compensation algorithm.

Analog to Digital Conversion

Figure 31:
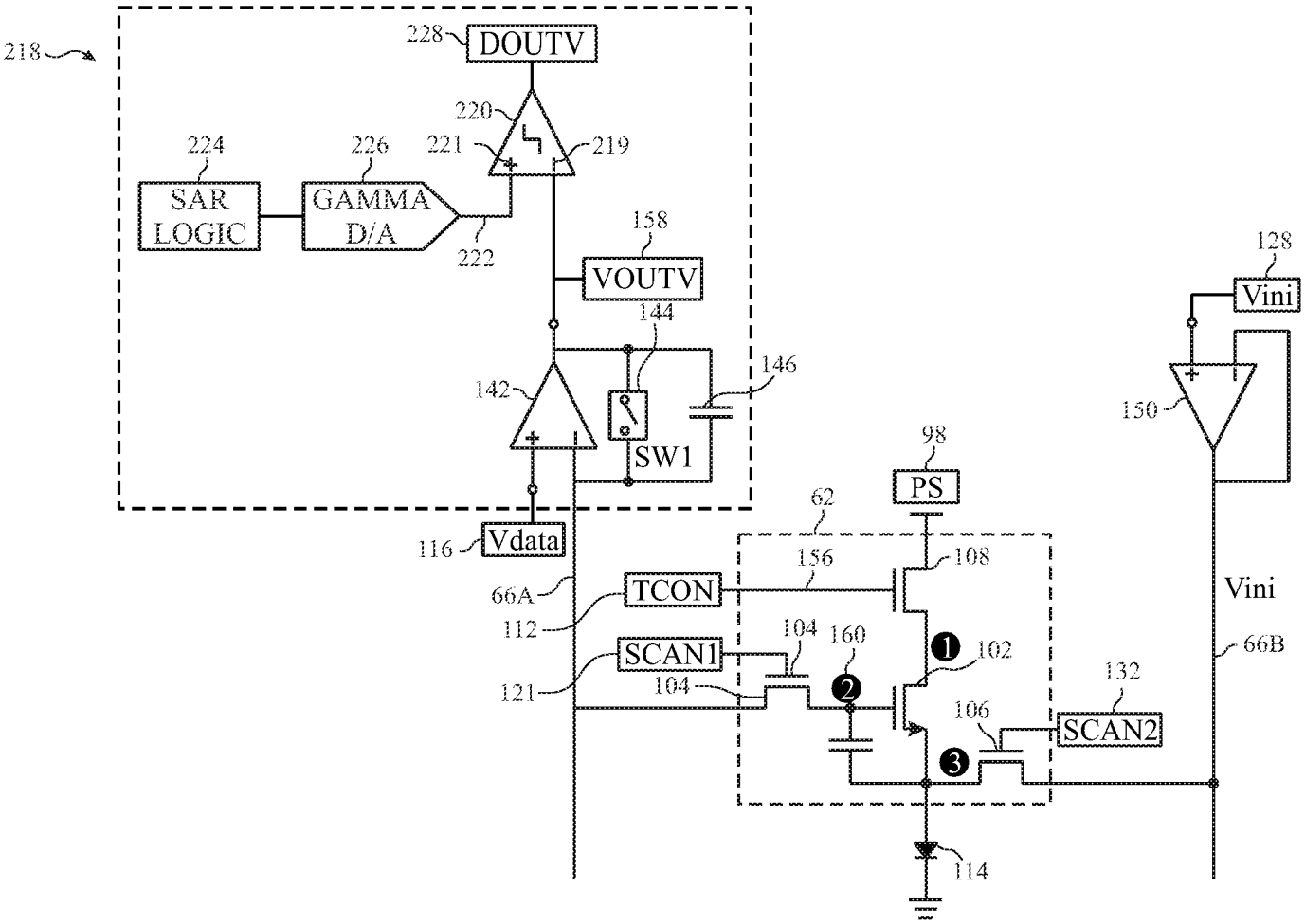
FIG. 31 is a circuit diagram of a charge sensing analog front-end circuit that converts output voltage values from an analog representation to a digital representation, in accordance with an embodiment.

When reading values of Vout 158, it may be beneficial for a resulting measurement to be converted from an analog signal to a digital signal. Accordingly, FIG. 31 illustrates charge sensing analog front-end circuitry 218 that converts values of Vout 158 from an analog representation to a digital representation. The charge sensing analog front-end circuitry 218 may be implemented within any of the measurement circuitry 100, the timing controller 112, or the source driver IC 90. In the charge sensing analog front-end circuitry 218, a signal representing a value of Vout 158 may be provided to a negative terminal 219 of a comparator 220. Additionally, a positive terminal 221 of the comparator 220 may receive a signal (Vdac 222) from a gamma digital-to-analog converter (DAC) 226, which converts a digital signal from a successive approximation register (SAR) logic device 224.

The SAR logic device 224 provides a starting voltage indication to the gamma DAC 226 for a voltage comparison between the analog value of Vout 158 and the value of Vdac 222. The comparator 220 makes a determination of whether Vout 158 is greater or less than Vdac 222. The result of this comparison, digital output voltage (DOUTV) 228, is fed back to the SAR logic device 224. Depending on whether DOUTV 228 is a logic high value or a logic low value, the SAR logic device 224 may alter a most significant bit, and the SAR logic device 224 may continue to the next bit and performs the comparison again. Upon performing this comparison for a least significant bit of the SAR logic device 224, the SAR logic device 224 may provide a digital indication of the value of Vout 158. In this manner, the charge sensing analog front-end circuitry 218 may be used when determining digital representations of Vout 158 values for calculating either or both of the Vth values or Voled values, as described above.

Figure 32:
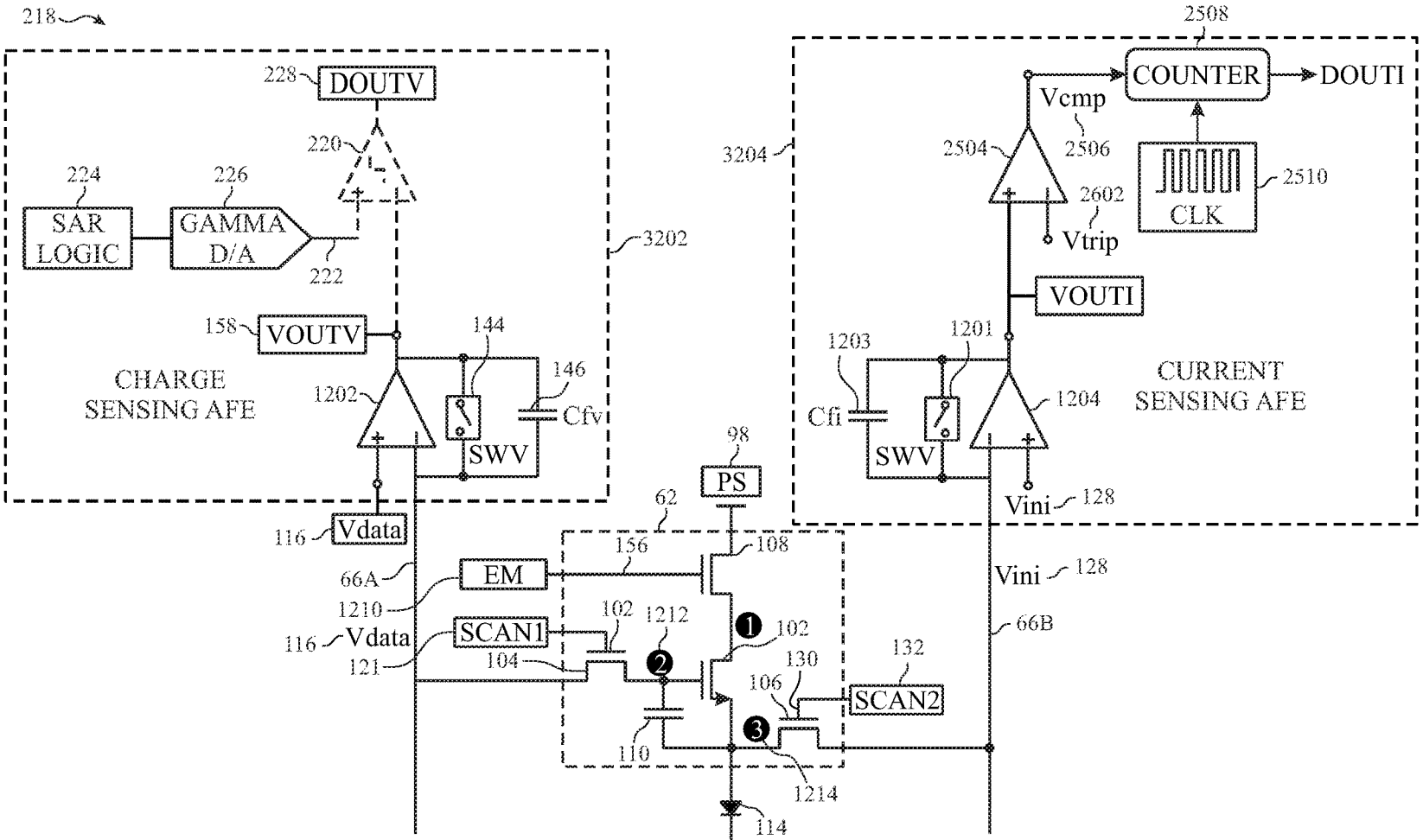
FIG. 32 is a schematic diagram illustrating circuitry that implements both the charge sensing techniques and the current sensing techniques, in accordance with an embodiment.

In one embodiment, the charge sensing techniques and the current sensing techniques may be combined. In FIG. 32, charge sensing analog front-end (AFE) circuitry 3202 utilizes the Vdata 116 line 66*a* and current sensing analog front-end (AFE) circuitry 3204 utilizes the Vini 128 line 66B.

As mentioned in FIG. 32, the charge sensing AFE circuitry 3204 may use the first amplifier 1202, the switch 144, the capacitor 146, a voltage output Vout 158, SAR logic 224, Gamma D/A 226, and a comparator 220 to determine charges of the pixel circuitry 62. The charges may be determined in accordance with the discussion provided in FIG. 31.

Further, as mentioned in FIG. 32, the current sensing AFE 3204 may use the switch 1201, the capacitor 1203, the second amplifier 1204, a third amplifier 2504, the Vini input 128, a Vtrip input 2602, a Vcmp output 2506, a counter 2508, and a clock 2510 to determine a current of the pixel circuitry 62. The current may be determined, via the current sensing AFE circuitry 3204, in accordance with the discussion provided in FIGS. 25-27.

In some embodiments, for decreased hardware overhead, certain components may be shared between the charge sensing AFE circuitry 3202 and the current sensing AFE circuitry 3202. In particular, the comparator 220 and amplifier 2504 may be shared, while retaining the ability to determine both charges via the circuitry 3202 and the current from the circuitry 3204.

Pixel Compensation

Figure 33A:
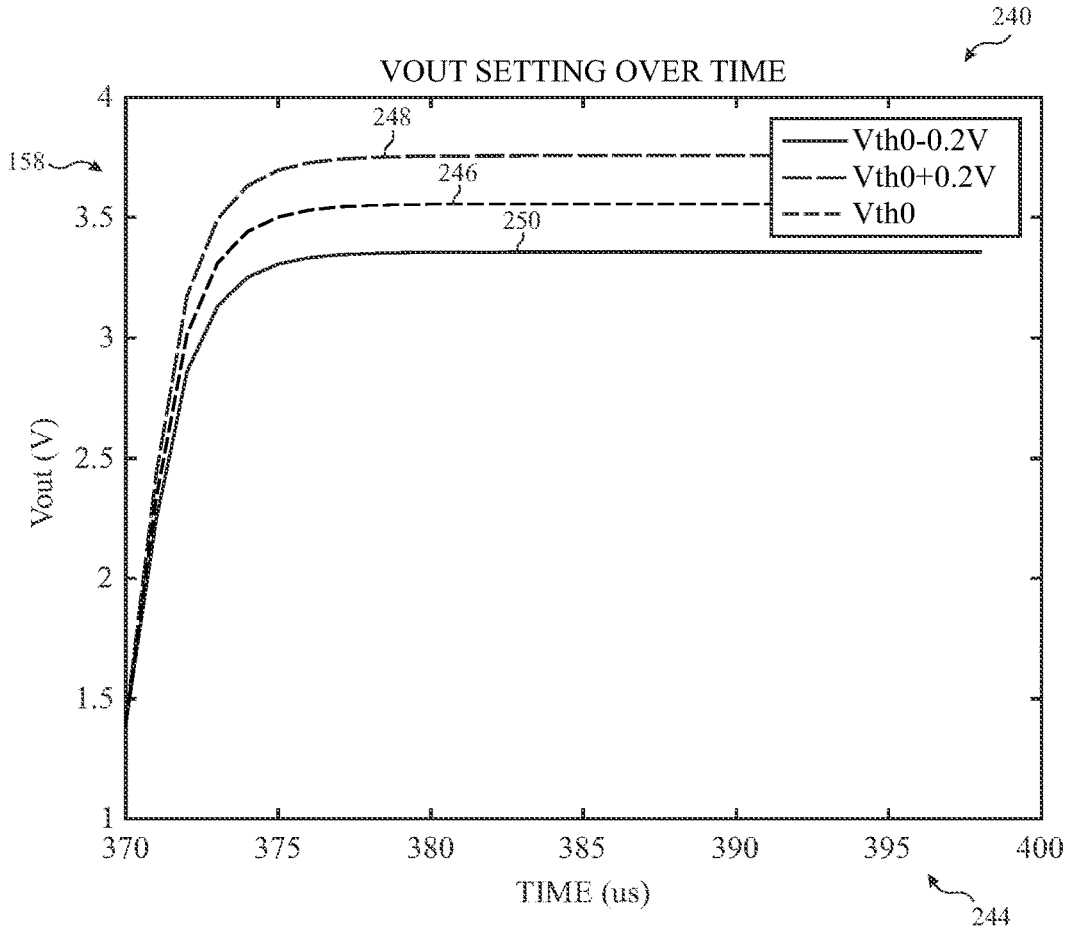
FIG. 33A is a chart of a simulation of an output voltage of an organic light emitting diode pixel settling over time, in accordance with an embodiment.
Figure 33B:
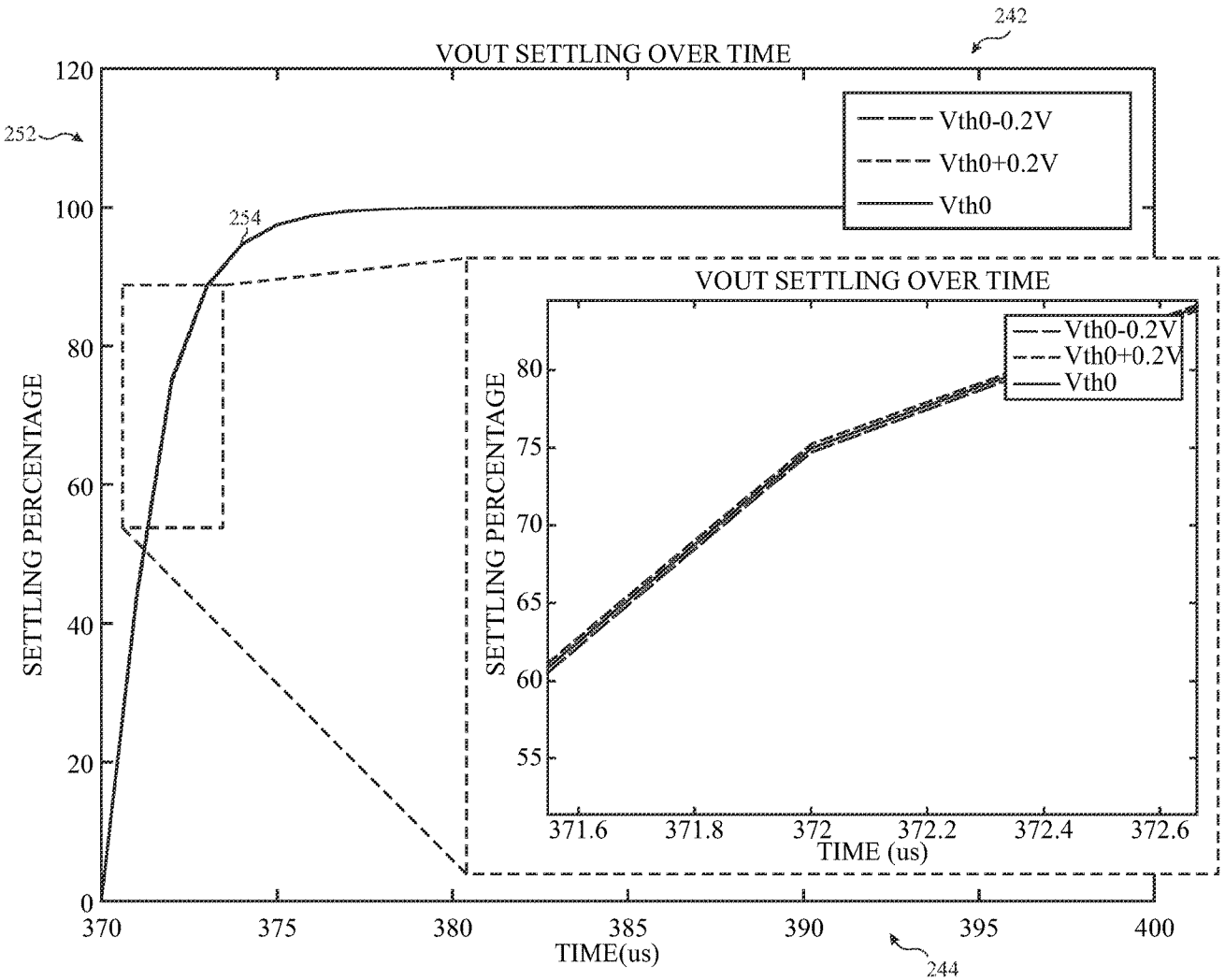
FIG. 33B is a chart of a simulation of a settling percentage of the output voltage of FIG. 33A over time, in accordance with an embodiment.

Turning now to FIGS. 33A-33B, charts 240 and 242 provide a simulation of Vout 158 settling over time 244. In FIG. 33A, the chart 240 includes a vertical axis representing Vout 158 and a horizontal axis representing the time 244. The three curves 246, 248, and 250 provided in the chart 240 represent the Vout settling when the threshold voltages are Vth, Vth+0.2V, and Vth−0.2V, respectively. The curves 246, 248, and 250 depict settling of the Vout 158 value over time when the pixel unit 62 is in a readout phase. At a time prior to settling of the Vout 158 values, the settling behavior may be characterized. Accordingly, with settling behavior representing a first order linear system, an accurate prediction of the settled value of Vout 158 may be determined much earlier than when waiting for the system to settle.

FIG. 33B depicts the chart 242 including a vertical axis representing a settling percentage 252 and a horizontal axis representing the time 244. The three Vth values generally track the same curve 254 over the time 244. Accordingly, regardless of the Vth value, the settling behavior, as indicated in FIGS. 33A and 33B is very similar. For example, the difference in settling behavior may be 2% or less.

To extrapolate the settled value of Vout 158, a measurement of Vout 158 may be taken early in the settling period at a time T1. Because the settling percentage 252 is known at time T1, a value at settled time T2 for Vout 158 may be extrapolated from the reading at time T1. Once the extrapolated value for Vout at the settled time T2 is measured, the calculation for Vth, Voled, or Ioled may occur.

Additionally, compensation for changes in Vth, Voled, and Ioled may be based on a polynomial equation. A first order polynomial equation may be assumed sufficient to determine coefficients of the first order polynomial equation. For example, for Vth sensing, the equation Vdata_new=Vdata_old+k_Vth*Vth_variation may be used to determine a compensated value of Vdata 116, where k_Vth is a known constant. For Voled sensing, the equation Vdata_new2=Vdata_new1+k_Voled*Voled_variation may be used to determine a compensated value of Vdata 116, where k_Voled is a known constant. Additionally, for current sensing, the equation Vdata_new3=Vdata_new2+k_Isen*Isen_variation may be used to determine a compensated value of Vdata 116, where k_Isen is a known constant.

Indirect Threshold Voltage Sensing

Figure 34:
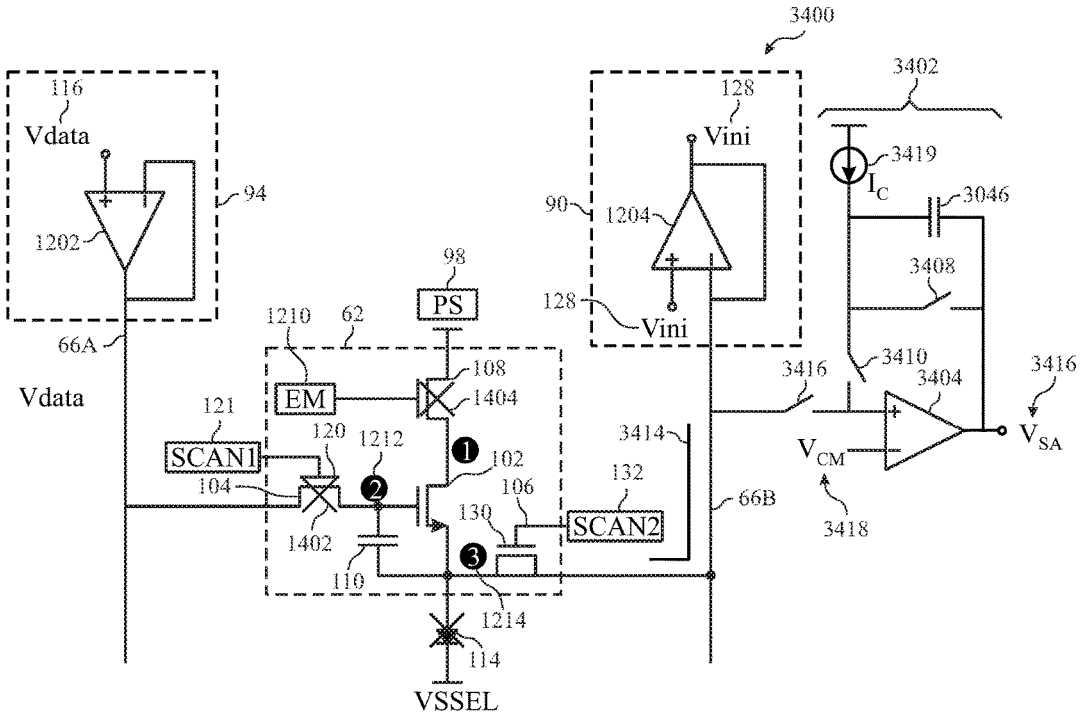
FIG. 34 is a circuit diagram including a sensing channel to indirectly sense a threshold voltage of a pixel, in accordance with an embodiment.
Figure 35:
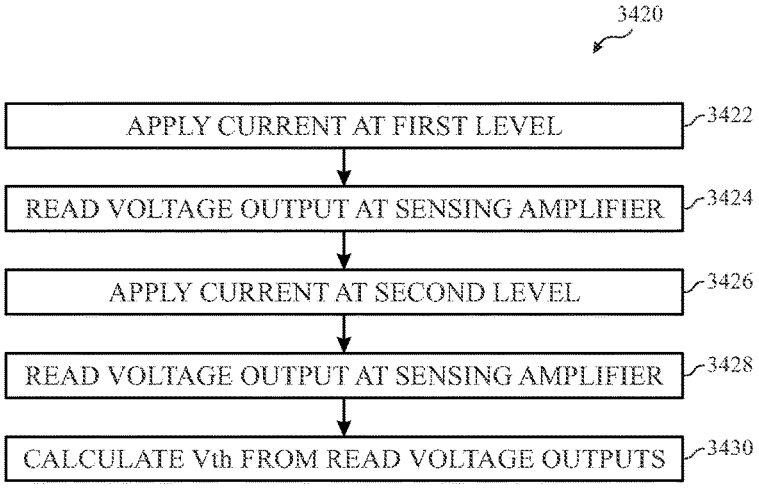
FIG. 35 is a method of calculating a threshold voltage from the circuit diagram of FIG. 34, in accordance with an embodiment.

Turning now to a discussion of techniques for measuring threshold voltage (Vth) using an indirect measurement through current sensing, FIG. 34 illustrates a circuit diagram 3400 including a sensing channel 3402 to indirectly sense a threshold voltage of the pixel 62. Further, FIG. 35 is a method 3420 for indirectly measuring the threshold voltage of the pixel 62 with the sensing channel 3402 of FIG. 34. For clarity, FIGS. 34 and 35 will be discussed together.

FIG. 34 is a schematic diagram of the unit pixel 62 and the sensing channel 3402. As depicted, the data voltage source 116 is amplified by an amplifier 1202 within the gate driver IC 94. Similarly, the initialization voltage source 128 is amplified by the amplifier 1204 within the source driver IC 90. In some embodiments, the sensing channel 3402 may be included within the source driver IC 90, or, in other embodiments, the sensing channel 3402 may be separate from the source driver IC 90. Additionally, each column of the unit pixels 62 may include a sensing channel 3402 that is separate from sensing channels of other columns of the unit pixels 62.

The sensing channel 3402 may include a sensing amplifier 3404 and an integrating capacitor 3406. The sensing amplifier 3404 and the integrating capacitor 3406 function together as an amplifier integrator capable of producing a signal that is representative of a current coming from the unit pixel 62. Further, the sensing channel 3402 may include several switches 3408, 3410, and 3412. The switches may perform various functions such as resetting the integrating capacitor 3406 and programming the integrating capacitor 3406, as described in greater detail below. Further, the initialization voltage source 128 from the data line 66B may be fed into a negative terminal of the sensing amplifier 3404 when the switch 3412 is closed.

The negative terminal of the sensing amplifier may also receive pixel current when the switch 3412 is closed and/or panel current leakage when the switch 3412 is closed. Further, a positive terminal of the sensing amplifier 3404 may receive voltage from a comparison voltage ($V_{CM}$) 3418. An output ($V_{SA}$) 3416 of the sensing amplifier 3404 may be provided to compensation circuitry 3452, as discussed in detail in the discussion of FIGS. 36-38 below. The compensation circuitry 3452 may compensate for the current leakage that is provided to the negative terminal of the sensing amplifier 3404 during operation of the sensing channel 3402. Moreover, a calibration current source 3419 is also provided in the sensing channel 3402. The calibration current source 3419 provides calibration of the sensing amplifier 3404 to compensate for gain and offset resulting from component mismatch in each of the sensing channels 3402. It may also be appreciated that while FIG. 34 depicts a schematic diagram including an NMOS variant of the driving TFT 102 for the unit pixel 62, in other embodiments the unit pixel 62 may similarly be built around a PMOS variant of the driving TFT 102. Accordingly, the threshold voltages may be sensed and compensated for using similar techniques for a PMOS variant to those techniques described herein.

The method 3420 of FIG. 35, which may be used to calculate the threshold voltage, may utilize the circuitry of FIG. 34 described above. At block 3422, a current 3414 may be applied on the data line 66B at a first level. The current 3414 may be provided from a calibration current source 3419 of the sensing channel 3402 when the switches 3410 and 3412 are closed. In another embodiment, the current 3414 may be applied from any other current source coupled to the data line 66B.

At block 3424, the voltage output 3416 may be read from the sensing amplifier 3404. The voltage output 3416 may be related to the threshold voltage by the following equation:

$$V_{SA1} = \frac{T}{C_f}\beta(V_{gs1} - V_{th})^2 \tag{1}$$

where $V_{SA1}$ is the voltage at the output 3416 for the current applied at block 3422, T is the temperature of the system, $C_f$ is the capacitance of the integrating capacitor 3406, β is a constant, $V_{gs1}$ is the voltage at the storage capacitor 110 of the unit pixel 62 during application of the first current level to the data line 66B, and $V_{th}$ is the threshold voltage of the driving transistor 102.

At block 3426, the current 3414 may be applied on the data line 66B at a second level. As with applying the first level of current, the current source may be provided from the compensating current source 3419, or the current source may be any other current source that is coupled to the data line 66B. Additionally, the second level of the current 3414 may be a current level that is slightly higher or slightly lower than the first current provided to the data line 66B at block 3422. For example, the second current level may be between 5% and 15% higher or lower than the first current level. It may also be appreciated that this range may be larger or smaller than 5% to 15% in some embodiments.

Subsequently, at block 3428, the voltage output 3416 may be read from the sensing amplifier 3404 for the application of the second current level. The voltage output 3416 may be related to the threshold voltage by the following equation:

$$V_{SA2} = \frac{T}{C_f}\beta(V_{gs2} - V_{th})^2 \tag{2}$$

where $V_{SA2}$ is the voltage at the output 3416 for the current applied at block 3426, T is the temperature of the system, $C_f$ is the capacitance of the integrating capacitor 3406, β is a constant, $V_{gs3}$ is the voltage at the storage capacitor 110 of the unit pixel 62 during application of the second current level to the data line 66B, and Vth is the threshold voltage of the driving transistor 102. It may be appreciated that blocks 3422 and 3424 may be performed after blocks 3426 and 3428. Additionally, it may be appreciated that blocks 3422 and 3424 may be performed during one frame of the output of the display 18, while blocks 3426 and 3428 are performed during a subsequent frame of the output of the display 18. Further, the blocks 3422-3428, in some situations, may all be performed during a single frame of the output of the display 18.

After reading the voltage output 3416 for both the first and second current levels applied to the data line 66B, at block 3430, the threshold voltage may be calculated from the read voltage outputs 3416. For example, using equations 1 and 2 above, the following equation may be derived:

$$V_{th} = V_{gs1} = \sqrt{\frac{V_{SA2}}{V_{SA2} - V_{SA1}}} * (V_{gs2} - V_{gs1}) \tag{3}$$

Because the voltages at the output 3416 are known, and because the voltages at the storage capacitor 110 are known, the threshold voltage is solvable using equation 3. Additionally, the resulting value for the threshold voltage is not sensitive to the capacitance of the integrating capacitor 3406 because the effect of the capacitance is cancelled out by applying the two different current levels. Moreover, while an extra step is involved by indirectly measuring the threshold value using two different current values that are applied to the unit pixel 62, calibration may be accomplished for the entire column of unit pixels 62 associated with the sensing channel 3402. Accordingly, there is an order of magnitude less calibration of the display 18 because the calibration is performed per channel instead of per pixel.

Additionally, in a similar embodiment, the indirect method for calculating Vth using two different current levels may also be applied when using two different voltage levels on the data line 66B. That is, instead of an indirect current process for measuring $V_{th}$, an indirect charge process for measuring $V_{th}$ may be used. For example, in the method described in FIGS. 12-15, charge based $V_{th}$ sensing is based on storing $V_{th}$ as a charge on the storage capacitor 110 and transferring the charge to the feedback capacitor 1203, as described in the discussion of FIGS. 12-15. A ratio of a capacitance of the feedback capacitor 1203 to a capacitance of the storage capacitor 110 (e.g., Cf/Cgs) and an output voltage of the amplifier 906 may be used to extract a value of the threshold voltage. On the other hand, in using the indirect charge sensing process to calculate the threshold voltage, the capacitance (e.g., Cgs) of the storage capacitor 110 of the unit pixel 62 may be removed from an equation used to calculate the threshold voltage. Accordingly, the use of two different voltage measurements may enable calibration based on the threshold voltage independent of the unknown capacitance of the storage capacitor 110. Therefore, the compensation may occur across a channel of the unit pixels 62 instead of at the individual unit pixels 62. Compensating across the channel of the unit pixels 62 may reduce processing time and memory used to accomplish compensation of the panel 60 of the display 18.

Figure 36:
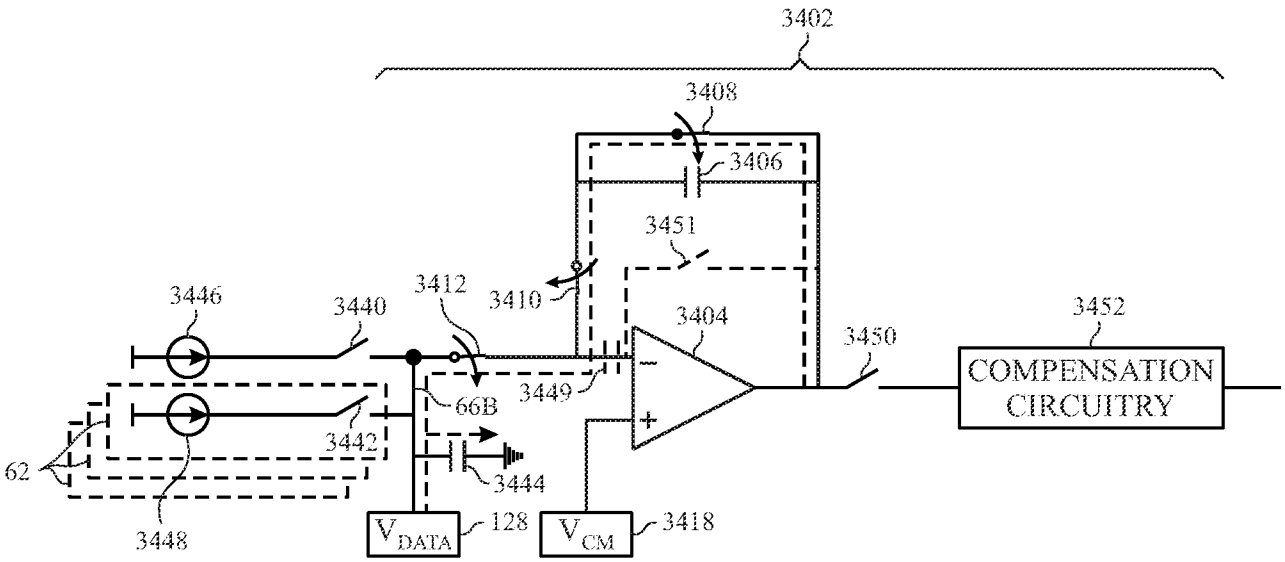
FIG. 36 is a schematic diagram of the sensing channel of FIG. 34 during a programming phase of measuring current leakage of the pixel of FIG. 34, in accordance with an embodiment.
Figure 37:
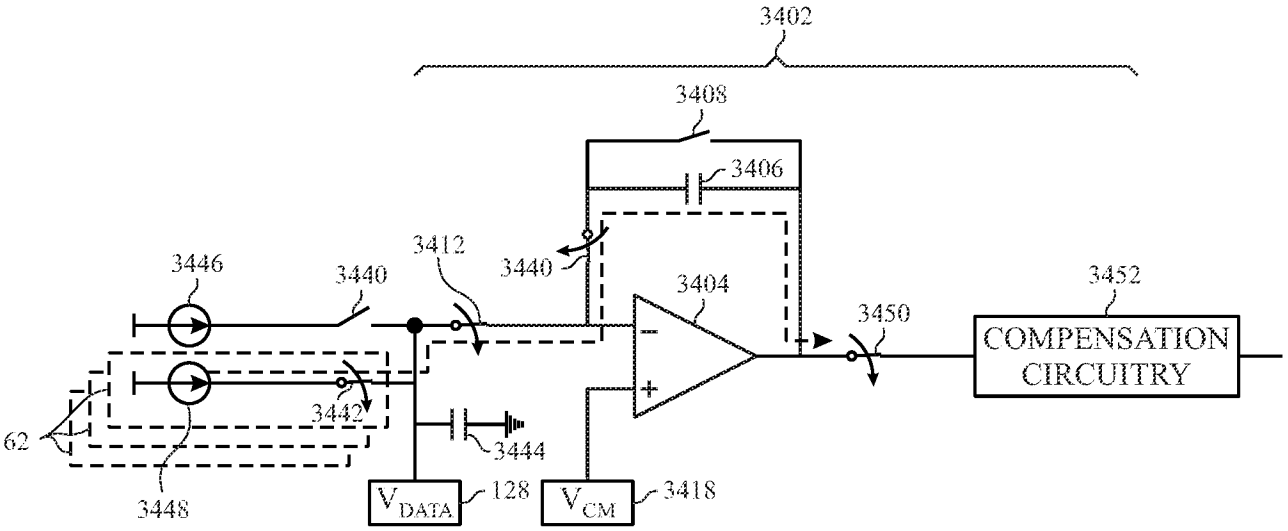
FIG. 37 is a schematic diagram of the sensing channel of FIG. 34 during a current leakage sensing phase of the pixel of FIG. 34, in accordance with an embodiment.
Figure 38:
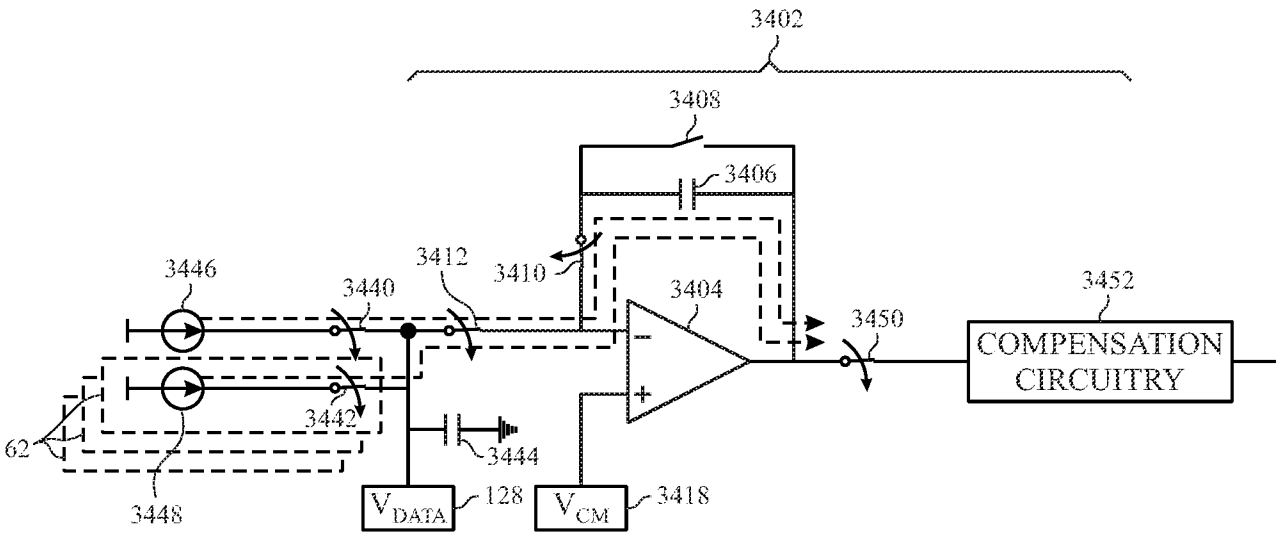
FIG. 38 is a schematic diagram of the sensing channel of FIG. 34 during a pixel current and current leakage sensing phase of the pixel of FIG. 34, in accordance with an embodiment.

Turning now to FIGS. 36-38, a discussion of separating a pixel current 3446 from panel leakage current 3448 is provided through three stages that accomplish compensation of the panel current leakage 3448 using the compensation circuitry 3452. For example, FIG. 36 depicts a programming stage of the sensing channel 3402. As illustrated, a line capacitor 3444 may be coupled between the data line 66B of the initialization voltage source 128 and ground. A capacitance of the line capacitor 168 may be in range of 10 pF-100 pF, which may be approximately 100-1000 times larger than a capacitance of the integrating capacitor 3406. The programming stage is used to program the integrating capacitor 3406 and the line capacitor 3444 from the initialization voltage source 128. To program the capacitors 3406 and 3444, the switches 3408, 3410, and 3412 may be closed while switches 3440, 3442, and 3450 remain open. Upon closing the switches, the integrating capacitor 3406 discharges and the line capacitor 3444 charges to a voltage equal to the voltage of the initialization voltage source 128. It may be appreciated that in some embodiments, prior to the programming stage or as a part of the programming stage described above, auto-zero circuitry may also be activated. The auto-zero circuitry may include an auto-zero capacitor 3449 and an auto-zero switch 3451 that correct for an input offset that may occur in the system of the panel 60.

Once the sensing channel 3402 is programmed, the integration (i.e., sensing) of the panel current leakage 3448 at the sensing amplifier 3404 and the integrating capacitor 3406 is performed, as illustrated in FIG. 37. To accomplish the integration of the panel current leakage 3448, the switches 3410, 3412, 3442, and 3450 are closed while the switches 3408 and 3440 are opened. The resulting output, which is a signal representative of the current leakage 3448, of the sensing amplifier 3404 is then provided to the compensation circuitry 3452.

Subsequently, the sensing channel 3402 is reprogrammed by closing switches 3408, 3410, and 3412 and opening switches 3440, 3442, and 3450, as illustrated in FIG. 36. Once reprogramming is accomplished, integration (i.e., sensing) of the current leakage 3448 and a pixel current 3446 by the sensing amplifier 3404 and the integrating capacitor 3406 is performed, as illustrated in FIG. 38. To accomplish the integration of the current leakage 3448 and the pixel current 3446, switches 3410, 3412, 3440, and 3442, and 3450 are all closed and switch 3408 is opened. The resulting output, which is a signal representative of both the current leakage 3448 and the pixel current 3446, is provided to the compensation circuitry 3452.

The compensation circuitry 3452 may include correlated double sampling circuitry, automatic gain control circuitry, and an analog to digital converter. The correlated double sampling circuitry may compensate for the current leakage 3448 that is provided to the negative terminal of the sensing amplifier 3404 during operation of the sensing channel 3402. In operation, the correlated double sampling circuitry may remove the value of the current leakage 3448 measured in FIG. 37 from the value of the combination of the current leakage 3448 and the pixel current 3446 measured in FIG. 38 to isolate only the value representative of the pixel current 3446. The value representative of the pixel current 3446 may be provided to the automatic gain control circuitry and, ultimately, the analog to digital converter. The automatic gain control circuitry may control a gain of the signal to an appropriate level for the analog to digital converter. The resulting digital signal represents a value of the pixel current 3446 that may be used by the processor 12 to determine a threshold voltage using the equations discussed above.

Figure 39:
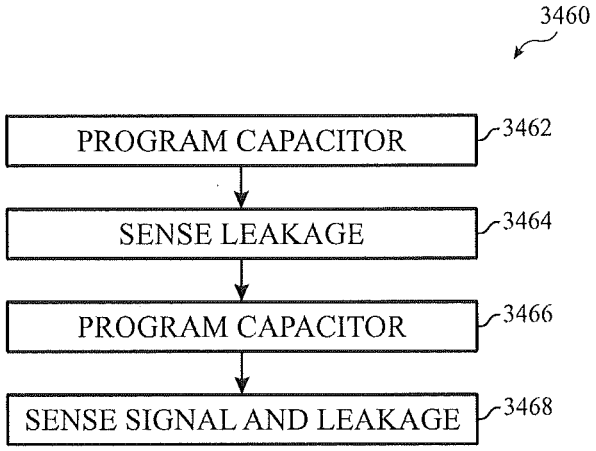
FIG. 39 is a method of sensing a leakage measurement from the sensing channel of FIGS. 36-38, in accordance with an embodiment.

Turning to FIG. 39, a method 3460 utilizing the stages described in FIGS. 36-38 to calculate a threshold voltage is provided. At block 3462, the integrating capacitor 3408 and the line capacitor 3444 are programmed, as illustrated in FIG. 36. During block 3462, the integrating capacitor 3406 discharges and the line capacitor 3444 charges to a voltage equal to the voltage of the initialization voltage source 128. Additionally, block 3462 may also include the auto-zero programming step to correct for an input offset in the system, as described above.

Subsequently, at block 3464, the panel leakage current 3448 may be sensed, as illustrated in FIG. 37. As mentioned above, block 3464 measures just the panel leakage current 3448 without the additional pixel current 3446. The resulting output from the sensing amplifier is provided to the compensation circuitry 3452.

At block 3466, the integrating capacitor and the line capacitor 3444 are reprogrammed using the same process as block 3442 that is illustrated in FIG. 36. The reprogramming may be accomplished to ready the system for another measurement. Accordingly, at block 3468, the signal, which is represented by the pixel current 3446, and the panel leakage current 3448 may be sensed, as illustrated in FIG. 38. The pixel current 3446 may change based on the current applied to the data line 66B for the threshold voltage measurement calculations. For example, the pixel current 3446 may be at one level for the first current level applied to the data line 66B and another level for the second current level applied to the data line 66B. Therefore, the method 3460 may first be performed when the first current level is applied to the data line 66B during a first frame of the display 18, and the method 3460 may be repeated when the second current level is applied to the data line 66B during a subsequent frame of the display 18. The resulting outputs from the compensation circuitry 3452 may be representative of $V_{SA1}$ and $V_{SA2}$ of equations 1-3 that are used to determine the voltage threshold, as discussed above.

Figure 40:
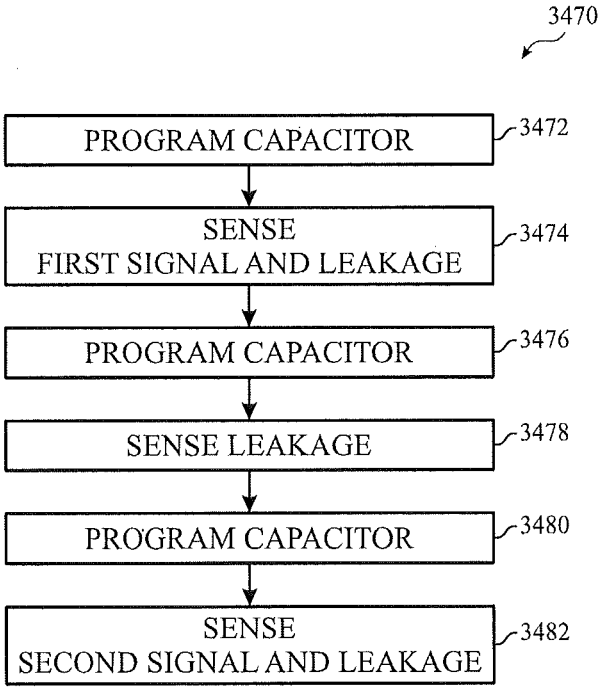
FIG. 40 is an alternative method of sensing a leakage measurement from the sensing channel of FIGS. 36-38, in accordance with an embodiment.

In another embodiment, FIG. 40 is a method 3470 for measuring the first voltage output 3416 and the second voltage output 3416 in the same frame of the display 18. At block 3472, the integrating capacitor 3406 and the line capacitor 3444 are programmed, as illustrated in FIG. 36. Subsequently, at block 3474, a first signal, which is represented by the pixel current 3446, from the first current level applied to the data line 66B and the panel leakage current 3448 may be sensed, as illustrated in FIG. 38. After sensing the first signal from the pixel current 3446 and the panel leakage current 3448, at block 3476, the integrating capacitor 3406 and the line capacitor 3444 may be reprogrammed, as illustrated in FIG. 36. Further, at block 3478, the integration of the panel current leakage 3448 at the sensing amplifier 3404 and the integrating capacitor 3406 is performed, as illustrated in FIG. 37. Then, at block 3480, the integrating capacitor 3406 and the line capacitor 3444 may again be reprogrammed. After reprogramming the capacitors 3406 and 3444 at block 3480, a second signal, which is represented by the pixel current 3446, resulting from the second current level applied to the data line 66B and the panel leakage current 3448 may be sensed, as illustrated in FIG. 38.

Figure 41:
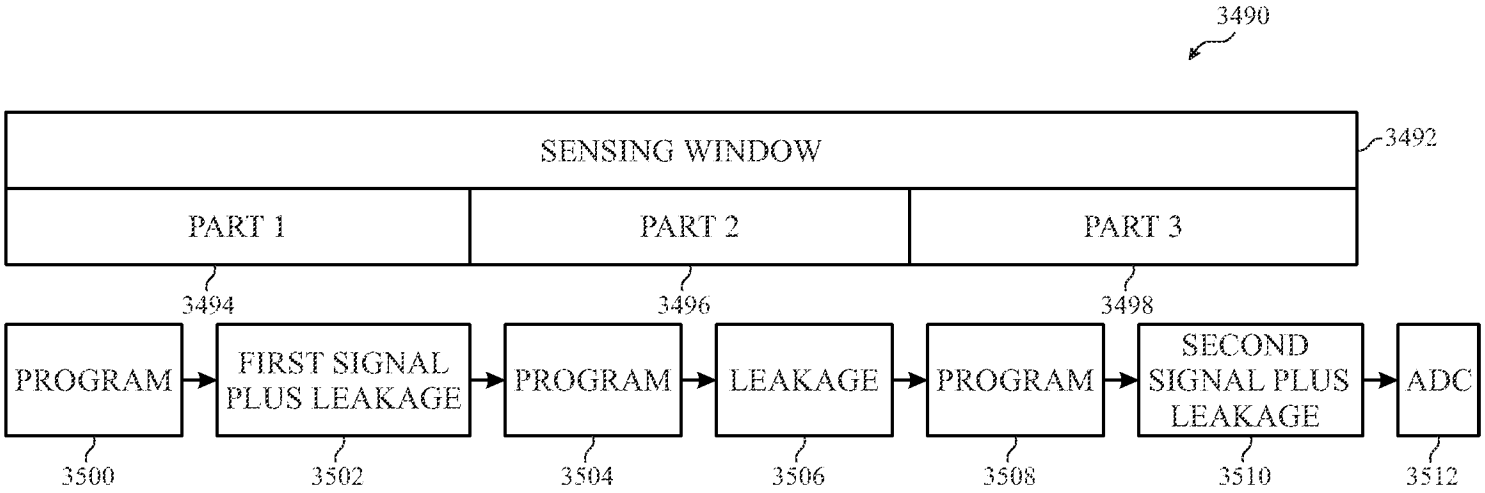
FIG. 41 is a timing diagram of the method of FIG. 40, in accordance with an embodiment.

As mentioned above, the method 3470 may occur over the course of a single frame of the display 18. In this manner, FIG. 41 illustrates a timing diagram 3490 during which the method 3470 is carried out over the course of the sensing window 3492, which represents a period of time during a single frame of the display 18. The sensing window 3492 may include three parts 3494, 3496, and 3498, which correspond to different measurements of the display 18. Further, the sensing window 3492 may take place over the course of 30 microseconds. Additionally, in some embodiments, the sensing window 3492 may be in the range of approximately 1 microsecond to several hundred microseconds, and the range may be programmable with coarse and/or fine steps.

The first part 3494 may include a programming block 3500 followed by a first signal plus leakage sensing block 3502. That is, during the first part 3494, the capacitors 3406 and 3444 may be programmed at block 3500, and the first signal related to the first current level and the panel leakage current 3448 may be sensed by the sensing channel 3402. Additionally, during the second part 3496, the capacitors 3406 and 3444 may be reprogrammed at block 3504, and the panel leakage current 3448 may be sensed individually at block 3506. Further, during the third part 3498, the capacitors 3406 and 3444 may again be reprogrammed at block 3508, and the second signal related to the second current level and the panel leakage current 3448 may be sensed at block 3510.

The resulting values from the sensing window 3492 may be fed into an analog to digital controller 3512 the output of which may be used in determining the threshold voltage using equations 1-3, as described above. Further, the digital output of the analog to digital controller 3512 may also be used in calibrating the channel of the unit pixels 62 with the calculated threshold voltage. It may be appreciated that while the timing diagram 3490 includes the first, second, and third parts 3494, 3496, and 3498 in numerical order, the first, second, and third parts 3494, 3496, and 3498 may be arranged in any order. Further, while the first, second, and third parts 3494, 3496, and 3498 are illustrated as occupying equal amounts of processing time within the sensing window 3492, the first, second, and third parts 3494, 3496, and 3498 may each take different amounts of processing time. For example, the first part 3494 and the third part 3498 may each occupy 12.5 microseconds of the 30 microsecond sensing window 3492, and the second part 3496 may occupy only 5 microseconds of the 30 microsecond sensing window 3492.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A processor-implemented method for threshold voltage (Vth) sensing, comprising:

sampling a charge of a capacitor of a unit pixel by configuring the unit pixel, such that a voltage of a second node of the unit pixel is a data voltage (Vdata) supplied by a first data line and a voltage of a third node of the unit pixel is an initialization voltage (Vini);

shorting a feedback capacitor such that a voltage of a first plate of the capacitor is a first voltage of the unit pixel and a voltage of a second plate of the capacitor is the first voltage minus a Vth;

transitioning the voltage of the second node to a sum of the Vini and the Vth;

transitioning the voltage of the third node to the Vini;

reading out the Vth based at least in part on a change in the charge of the capacitor; and modifying an operation of the unit pixel based at least in part on the Vth, wherein the reading out of the Vth is made without toggling global busses coupled to the unit pixel.

2. The processor-implemented method of claim 1, wherein the reading out comprises:

removing a short of the feedback capacitor while voltages of the capacitor remain constant;

determining an output voltage (Vout); and determining the Vth based at least in part on the Vout, the first voltage, and the Vini.

3. The processor-implemented method of claim 1 implemented using at least a source line carrying the Vini, wherein the sampling comprises actuating settings of the unit pixel such that the voltage of the third node of the unit pixel transitions to a voltage difference between the Vdata and the Vth.

4. The processor-implemented method of claim 3, comprising:

removing a short of the feedback capacitor, such that the voltage of the third node transitions from the voltage difference between the Vdata and the Vth to the Vini;

determining an output voltage (Vout); and determining the Vth based at least in part on the Vout, the Vini, and the Vdata.

5. The processor-implemented method of claim 4, wherein Vth is determined according to the relationship: the Vout=the Vini−(the Vdata−the Vini−the Vth).

6. An electronic device, comprising:

one or more unit pixels each comprising a first node, a second node, and a third node; and threshold voltage (Vth) sensing circuitry configured to sense Vth of the one or more unit pixels, wherein the Vth sensing circuitry is configured to initialize the one or more unit pixels prior to sensing the Vth of the one or more unit pixels such that a voltage of the second node of the one or more unit pixels is set to a data voltage (Vdata) supplied by a Vdata line and a voltage of the third node is set to an initialization voltage (Vini) supplied by a source line, by:

sampling a charge of a capacitor of the one or more unit pixels, wherein the voltage of the second node remains at the Vdata during the sampling, and wherein the voltage of the third node transitions to a voltage difference between the Vdata and the Vth during the sampling;

transitioning from the sampling;

reading out the Vth based at least in part on a change in the charge of the capacitor; and modifying an operation of the one or more unit pixels based at least in part on the Vth, and wherein the reading out of the Vth is performed without toggling global busses coupled to each of the one or more unit pixels.

7. The electronic device of claim 6, wherein the transitioning from the sampling comprises the voltage of the second node transitioning to a sum of the Vini and the Vth, and the voltage of the third node transitioning to the Vini.

8. The electronic device of claim 7, wherein the reading out comprises determining the Vth based at least in part on the Vini, the Vdata, and a known output voltage (Vout).

9. The electronic device of claim 8, wherein the Vth is determined according to the following relationship: the Vth=2*the Vini−the Vdata+the Vout.

10. The electronic device of claim 6, wherein the reading out comprises determining the Vth based at least in part on the Vini, the Vdata, and a known output voltage (Vout), and wherein electrical signals provided from the source line remain constant during sensing.

11. The electronic device of claim 10, wherein the reading out comprises transitioning the voltage at the third node to equal the Vini by removing a short of a feedback capacitor.

12. The electronic device of claim 6, wherein the Vth sensing circuitry operates by:

applying a step down voltage to the one or more unit pixels to cause the voltage of the second node to equal the Vini and a voltage of the first node to equal the Vdata supplied via the source line; and outputting the Vth based at least in part on a known output voltage measured via an additional source line, the Vdata, and the Vini.

13. A tangible, non-transitory, machine-readable medium, comprising machine-readable instructions to:

sample a charge of a capacitor of a unit pixel comprising a first node, a second node, and a third node by:

setting a first scanning signal and a second scanning signal to a high logic signal and setting a third scanning signal and an emitter signal to a low logic signal;

closing a first switch, such that a voltage of the second node is set to a first applied reference voltage and a voltage of the third node is set to a threshold voltage (Vth);

setting the first scanning signal to the low logic signal; and setting the second scanning signal and the third scanning signal to the high logic signal, wherein the voltage of the second node is set to a sum of a second applied reference voltage and the Vth, and wherein the voltage of the third node is set to the second applied reference voltage;

sense the Vth using a data line carrying the second applied reference voltage;

read out the Vth based at least in part on a change in the charge of the capacitor configured to cause variable voltage outputs in response to the second applied reference voltage and the first applied reference voltage by:

setting the first scanning signal and the second scanning signal to the high logic signal; and determining the Vth based at least in part on the second applied reference voltage and a voltage output (Vout); and modifying an operation of the unit pixel based at least in part on the Vth, wherein the first applied reference voltage and the second applied reference voltage remain constant during Vth sensing.

14. The tangible, non-transitory, machine-readable medium of claim 13, wherein sensing the Vth includes using a data line carrying the first applied reference voltage, and wherein the determining the Vth is based at least in part on the first applied reference voltage, the second applied reference voltage, and the Vout.

15. The tangible, non-transitory, machine-readable medium of claim 13, wherein the first applied reference voltage and the second applied reference voltage are provided to the unit pixel via one or more global busses that are not toggled during Vth sensing.

16. A processor-implemented method for threshold voltage (Vth) sensing, comprising:

sampling a charge of a capacitor of a unit pixel by actuating settings of the unit pixel such that a second node of the unit pixel registers a voltage of a data voltage (Vdata) supplied by a first data line and a voltage of a third node of the unit pixel transitions to equal a voltage difference between the Vdata and the Vth, wherein at least a source line is configured to transmit an initialization voltage (Vini);

transitioning from sampling by removing a short of a feedback capacitor such that the voltage of the third node of the unit pixel transitions from the voltage difference between the Vdata and the Vth to equal the Vini;

determining an output voltage (Vout);

determining the Vth based at least in part on the Vout, the Vini, and the Vdata;

reading out the Vth based at least in part on a change in the charge of the capacitor; and modifying an operation of the unit pixel based at least in part on the Vth, wherein the reading out of the Vth is made without toggling global busses coupled to the unit pixel.

17. An electronic device, comprising:

one or more unit pixels comprising a first node, a second node, and a third node; and threshold voltage (Vth) sensing circuitry configured to sense Vth of the one or more unit pixels, wherein the Vth sensing circuitry is configured to initialize the one or more unit pixels prior to sensing Vth of the one or more unit pixels such that a voltage of the second node of the one or more unit pixels is set to a data voltage (Vdata) supplied by a Vdata line and a voltage of the third node is set to an initialization voltage (Vini) supplied by a source line, by:

sampling a charge of a capacitor of the one or more unit pixels;

transitioning from sampling;

reading out the Vth based at least in part on a change in the charge of the capacitor by determining the Vth based at least in part on the Vini, the Vdata, and a known output voltage (Vout), wherein two source lines are configured to respectively supply the Vini and the Vdata, and wherein electrical signals provided from the two source lines remain constant during sensing; and modifying an operation of the one or more unit pixels based at least in part on the Vth, and wherein the reading out of the Vth is performed without toggling global busses coupled to each of the one or more unit pixels.

18. An electronic device, comprising:

one or more unit pixels comprising a first node, a second node, and a third node; and threshold voltage (Vth) sensing circuitry configured to sense Vth of the one or more unit pixels by:

sampling a charge of a capacitor of the one or more unit pixels;

transitioning from sampling;

reading out the Vth based at least in part on a change in the charge of the capacitor by:

applying a step down voltage to a respective pixel of one or more unit pixels to cause a voltage of the second node to equal an initialization voltage (Vini) and a voltage of the first node to equal a data voltage (Vdata) supplied via a source line; and outputting the Vth based at least in part on a known output voltage measured via an additional source line, the Vdata, and the Vini; and modifying an operation of the one or more unit pixels based at least in part on the Vth, and wherein the reading out of the Vth is performed without toggling global busses coupled to each of the one or more unit pixels.

* * * * *